US011548680B1

(12) United States Patent
Brebner et al.

(10) Patent No.: US 11,548,680 B1
(45) Date of Patent: Jan. 10, 2023

(54) SYSTEM AND METHOD FOR LOCKING TOGETHER A SET OF SHEETS OF SEMI-RIGID MATERIAL

(71) Applicants: David Brebner, Palmerston North (NZ); David Dupuis, Stoneham, MA (US)

(72) Inventors: David Brebner, Palmerston North (NZ); David Dupuis, Stoneham, MA (US)

( * ) Notice: Subject to any disclaimer, the term of this patent is extended or adjusted under 35 U.S.C. 154(b) by 326 days.

(21) Appl. No.: 16/902,713

(22) Filed: Jun. 16, 2020

Related U.S. Application Data

(60) Provisional application No. 62/862,447, filed on Jun. 17, 2019.

(51) Int. Cl.
*B65D 5/42* (2006.01)
*E05B 65/00* (2006.01)
*B65D 55/02* (2006.01)

(52) U.S. Cl.
CPC ..... *B65D 5/4279* (2013.01); *B65D 55/02* (2013.01); *E05B 65/006* (2013.01)

(58) Field of Classification Search
CPC ..... B65D 5/4279; B65D 55/02; E05B 65/006
USPC ..... 70/2; 411/116, 123, 126, 399
See application file for complete search history.

(56) References Cited

U.S. PATENT DOCUMENTS 240,387 A * 4/1881 Cowdy ..... F16B 39/24 411/959
1,827,628 A * 10/1931 Twedell ..... F16B 35/06 411/285
1,946,800 A * 2/1934 MacLean ..... F16B 33/004 411/399
1,953,305 A * 4/1934 MacLean ..... F16B 35/048 411/399
3,389,734 A * 6/1968 Gutshall ..... F16B 39/282 411/959
4,490,082 A * 12/1984 Barth ..... F16B 39/282 411/545
4,705,441 A * 11/1987 Arnold ..... F16B 35/048 411/413

(Continued)

OTHER PUBLICATIONS

Makedo, https://www.make.do (2020).

(Continued)

*Primary Examiner* — J. Gregory Pickett
*Assistant Examiner* — Niki M Eloshway
(74) *Attorney, Agent, or Firm* — Sunstein LLP

(57) ABSTRACT

A system for locking together sheets of semi-rigid material. The system includes a clamp with a head having a clamp face, and a threaded rod having a first end affixed to the clamp face, and a second end that penetrates through the sheets. The system also includes a nut with a face forced into contact with the second side when tightened to the rod. The clamp face includes a gripping region, in a first circumferential position, with a trough and a hook that projects beyond the plane of the clamp face; and a leverage region, in a second circumferential position, that projects axially, so that, as the nut is tightened, the leverage region contacts the sheets' first side, and upon continued tightening, exerts a torque on the clamp head, elastically deforming the clamp so as to cause the hook to dig into the first side and prevent head rotation.

10 Claims, 25 Drawing Sheets

(56) References Cited

U.S. PATENT DOCUMENTS

| | | | | |
|---|---|---|---|---|
| 5,078,562 | A * | 1/1992 | DeHaitre | F16B 39/34 411/324 |
| 6,908,270 | B1 * | 6/2005 | Iwata | F16B 39/282 411/959 |
| 2011/0064540 | A1 * | 3/2011 | Walther | F16B 35/065 411/399 |
| 2013/0291605 | A1 * | 11/2013 | Liu | E05C 19/06 70/57 |

OTHER PUBLICATIONS

Amazon.com, Inc. https://www.amazon.com/Mr-McGroovys-Box-Rivets-Half/dp/B00FD5RNJS (1996-2020).

* cited by examiner

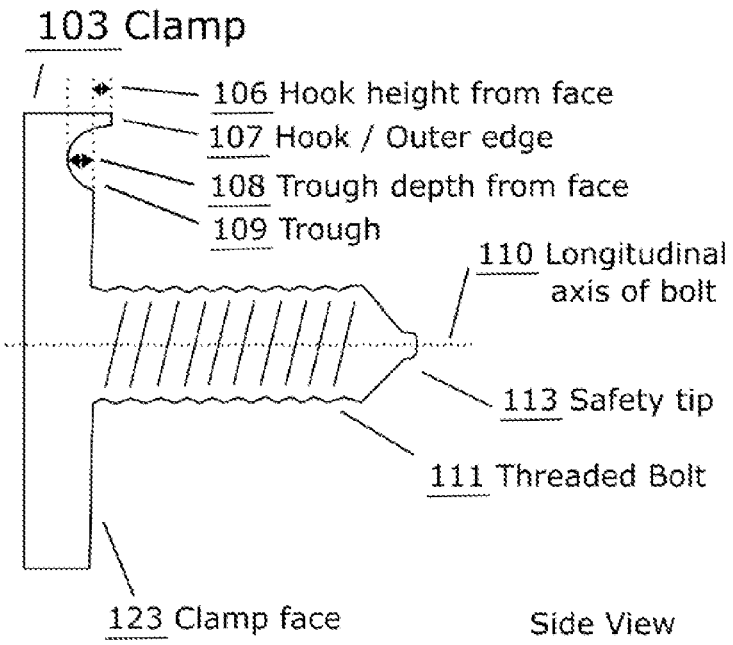
Fig. 1A
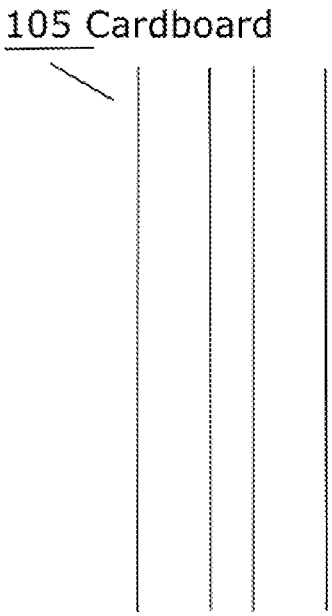
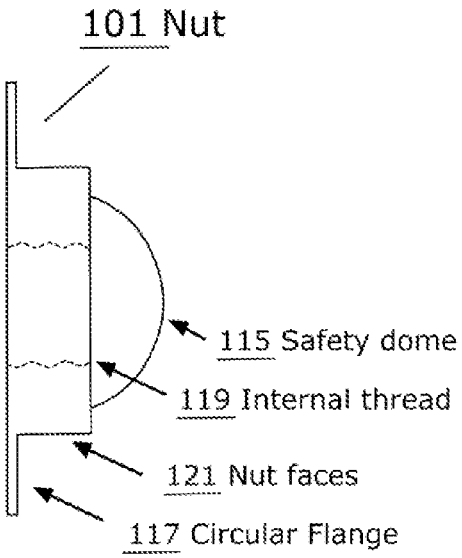
Fig. 1B
Fig. 1C 1001 90 degree I-Beam

1301 Socket Plug 90

The fixed socket with locking teeth allows any plug to be remounted at 90 degrees at a fixed but selected axial angle The Socket Clamp allows users to create their own custom rotating socket props 2001 Standard Torquing Clamp & Nut 2013 Clamping flexible materials 2213 Self Drilling Bolt, Torque Clamp & Nut 2301 Metal Self Tapping Wood Screw & Torque Clamp

SYSTEM AND METHOD FOR LOCKING TOGETHER A SET OF SHEETS OF SEMI-RIGID MATERIAL

PRIORITY

This patent application claims the benefit of U.S. provisional patent application 62/862,447, filed Jun. 17, 2019, which is hereby incorporated, in its entirety, by reference.

TECHNICAL FIELD

The present invention relates to Physical plastic parts to facilitate locking, clamping materials while optionally providing a firm base for attaching and rotating additional plastic parts.

BACKGROUND ART

Goods are commonly delivered to a purchaser in cardboard boxes. Once delivered goods are removed from a cardboard box, the purchaser usually has no further use for the cardboard box and it is discarded.

Boxes are typically constructed by cutting and folding cardboard and corrugated cardboard sheets and holding the cardboard together with single use glue and or metal staples and or adhesive tape. Sometimes children play with cardboard boxes by sitting in them, drawing on them or connecting them together with adhesive tape before the boxes are discarded.

SUMMARY OF THE EMBODIMENTS

In accordance with one embodiment of the present invention, there is provided a mechanical system for locking together a set of sheets including sheets of semi-rigid material. The system includes clamp including: a head having a clamp face and an outwardly disposed clamp back, the head having a periphery and the clamp face defining a face plane. The clamp also including: a threaded rod, affixed to the clamp face, having (i) a longitudinal axis disposed normally to the face plane before the clamp has been placed in use, (ii) a first end affixed to the clamp face, and (iii) a second end configured to penetrate through the set of sheets until the clamp head abuts an exposed first side of the set of sheets, and the second end emerges from an exposed second side of the set of sheets. The system also includes a nut, having an internal thread, configured to support its being screwed onto the threaded rod, the nut having a contact face forced into contact with the exposed second side when the nut is tightened. The clamp face is asymmetrically configured to include a gripping region in a first circumferential position of the clamp face and a leverage region in a second circumferential position opposed to the first circumferential position. The gripping region including a trough disposed near the periphery of the head and defining a hook, disposed between the trough and the periphery, the hook having a tip that projects beyond the face plane in a direction normal to the face plane. The leverage region is configured to project axially, in a region near the periphery of the head, so that, as the nut is tightened, the axially projecting portion of the leverage region first contacts the first side of the set of sheets, and upon continued tightening exerts a torque on the head, relative to the threaded rod, elastically deforming the clamp so as to cause the hook of the gripping region to dig into the first side and to prevent rotation of the head relative to the set of sheets.

Optionally, the second end of the threaded rod has a safety tip that facilitates penetration of the second end through the semi-rigid material. Optionally, the nut is configured with a flange to provide an enlarged surface area of the contact face. Optionally, the nut is configured with a safety dome that restricts a length by which the second end can extend into the internal thread of the nut. Optionally, the nut has an exposed side, opposed to the contact face, configured to engage with a suitable wrench. Optionally, the first side is of a sheet of thin yielding material and, the nut upon continued tightening exerts a torque on the head, relative to the threaded rod, elastically deforming the clamp so as to cause the hook of the gripping region to dig into the first side to an extent sufficient to engage the hook against sheets of semi-rigid material in the set.

Optionally, a plug and socket system is included for use with the mechanical system. The plug configured for use with the clamp as an integral part thereof, the plug configured for removable attachment of the socket. Alternatively or in addition, the plug and clamp are formed as a single piece. Optionally, the plug includes a plug barrel having a solid core and a plurality of circumferentially disposed flexible members, each member having a lip disposed radially outward, and wherein each of the members is configured to flex for insertion into the socket and the solid core provides a high strength inflexible rotational joint.

BRIEF DESCRIPTION OF THE DRAWINGS

The foregoing features of embodiments will be more readily understood by reference to the following detailed description, taken with reference to the accompanying drawings, in which:

FIG. 1A shows, in accordance with an embodiment of the present invention, a torqueing clamp, having a threaded bolt with a safety tip, for locking together sheets of corrugated cardboard or other rigid materials.

FIG. 1B shows, in accordance with an embodiment of the present invention, two sheets of cardboard positioned to be locked together by inserting the bolt of FIG. 1A through a hole punctured in each cardboard sheet by the bolt's safety tip.

FIG. 1C shows, in accordance with an embodiment of the present invention, a safety nut with a large flange configured to be tightened on the end of the bolt of FIG. 1A inserted through the cardboard sheets of FIG. 1B.

FIG. 5B shows a fixed socket, in accordance with an embodiment of the present invention, configured for locked rotation about the plug of FIG. 4A. The fixed socket of FIG. 5B has locking teeth, so when mounted to the plug, the socket engages all of the plug's teeth and fix the plug orientation at the selected rotation which has been locked in.

FIG. 6 also shows a socket connected to a clamp at ninety degrees. The clamp is clamped to another piece of cardboard with a nut. The plug and socket are then connected to create a rotating joint that forms a towball style hinge where the socket can be attached or removed from the plug to connect or disconnect the two surfaces in accordance with an embodiment of the present invention.

DETAILED DESCRIPTION OF SPECIFIC EMBODIMENTS

Figure 2A:
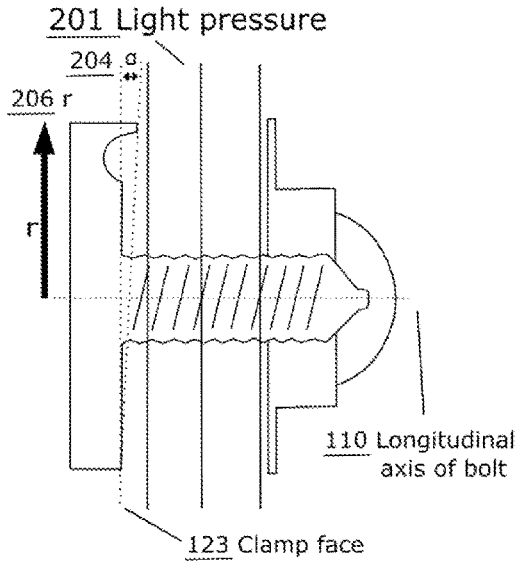
FIG. 2A shows, in accordance with an embodiment of the present invention, the torque clamp of FIG. 1A under light pressure during insertion into the cardboard sheets of FIG. 1B.

Definitions. As used in this description and the accompanying claims, the following terms shall have the meanings indicated, unless the context otherwise requires:

a "set" includes at least one member.

a "plane" is a flat surface on which a straight line joining any two points on it would wholly lie.

a "bolt" is a rod or dowel with external spiral raised thread a "longitudinal axis" is an axis running through the center of an object, in this case the bolt a "clamp" is to hold semi rigid sheets and flexible materials together a "clamp face" is a surface on the clamp which is a plane and is held firmly against a semi rigid sheet or flexible material to hold it in place a "clamp back" is the other side of the clamp from the face a "clamp head" combines the entirety of the clamp face and the clamp back a "trough" is a long narrow channel or container a "hook" is the curved tip of the trough at the outer edge of the clamp face a "nut" is a hollow cylinder with an internal spiral thread which receives a bolt and converts rotation into linear motion along the longitudinal axis of the bolt/nut a "nut flange" is a surface area larger than the nut to push against the semi rigid material to provide friction and counter pressure against the clamp head on the other side of the semi rigid material a "torque" is a description of the rotational equivalent of linear force a "Theta $\theta$" is the angle between the lever arm of the clamp face and the force vector along the longitudinal axis a "Tau $\tau$" is the torque, or moment of force around the point where the bolt joins the clamp face a "F force" is the force generated by the bolt and nut an "elastic modulus" is the moment of inertia for stiffness, relating to the clamp material properties and the clamp profile a "$\alpha$ alpha" is the angle described by the plane of the clamp face and an imaginary plane from the two outer edges of the clamp one on the clamp plane and the other along the edge of the raised hook a "I-Beam" describes the unique profile of a material designed to increase its rigidity by the distribution of the profile area a "I-Beam flange" describes the top and bottom sections of an I-Beam profile that are wider and provide the additional rigidity, these flanges can be any shape as long as they are wider than the center of the profile a "tooth" or "teeth" are the negative or positive teeth for a gear a "click lever" is a flexible length of material which can bend under pressure over a tooth from a gear a "plug" is a device for making a positive connection with a receiving void a "socket" is a device with a void for making a positive connection with a plug a "lock" is to join together two or more items so they cannot translate or rotate in relation to the other items a "clamp" is to hold in place by exerting pressure via friction between two clamping surfaces "reusable" is used to describe the ability to have parts be reused by being able to reverse and repeat an action, in this context, lock and unlock, clamp and unclamp and attach and detach a "semi-rigid material" is a material that exhibits some rigidity but may exhibit some flexure and can be conveniently cut and shaped. It is rigid by its nature or through the addition of bonding agents and or internal and or external structures to increase the rigidity. Examples of semi-rigid materials include plywood, surface coated cardboard, corrugated cardboard, fluted plastic.

a "flexible material" material can bend freely on one or more axis such as vinyl, cloth, insulation and other sheets of matted, knitted, woven, fabrics, paper, felts etc a "socket accessory" is an item designed with a socket to fit onto a plug, this can be a lever, wheel, steering wheel, dial or other accessory which can rotate freely, be fixed or rotate with stepping depending on the socket design a "hinge" is a joint allowing rotation around the primary axis of the hinge a "rod" is a cylinder a "claw is a pair of semi-circular fingers designed to hold a rod but allow the rod to rotate. The fingers are flexible enough to allow the rod to be clipped into the claws and unclipped under pressure and for the fingers to rotate around the central axis of the rod a "rod & claw" is a hinge which uses a claw or claws clipped onto a rod. These two components combine to form a hinge rotating around the rod a "split plug" or "split pin" is a male plug or pin with one or more splits to allow the flexing of the sides of the plug or pin a "lip" is a raised edge on the leading edges of a clip or split plug/pin that provides a pressure fit. The lip can be sharp so it is hard to reverse (pull out) or rounded so it requires equivalent pressure to the insertion to reverse (pull out)

a "spline" are one or more longitudinal grooves or ridges on an axle and the opposite but receiving ridges or grooves on a female socket. Splines allow the axle to be placed at a variable depth into the socket but still transfer rotation.

The primary domain is to allow corrugated cardboard boxes, paper and textiles to be used as a building medium for the construction of playthings for children. The constructions may vary from imaginary locations like houses, kitchens, shops and laboratories to imaginary vehicles like cars, planes and spaceships to imaginary animals like cats, dogs, ponies and dragons.

The first goal is to have a re-usable mechanism to lock together semi-rigid items such as cardboard boxes firmly and to clamp other items such as paper and textile in a robust way that is safe for children. It should also do minimal or no damage to the cardboard and other items.

The second goal is to have a re-usable mechanism for attaching additional plastic pieces as part of the system which should be able to rotate freely, be fixed at an angle or support a stepped rotation option. These rotational options should only depend on the design of the additional plastic pieces. (Note: the number of rotational positions for fixed or stepping rotation is only dependent on the number of teeth which is variable).

The system includes a re-usable mechanism to lock together semi rigid materials such as cardboard firmly and a re-useable mechanism to clamp other items such as paper and textile in a robust way against the cardboard that is safe for children. The system also includes a re-usable mechanism for attaching and detaching additional plastic pieces to the firmly affixed lock that can selectively rotate freely, be fixed at an angle or support a stepped rotation option.

The second domain is focusing on the re-useable locking/clamping mechanism for packaging and construction. Specifically to lock together composite sheets of semi rigid material and to clamp flexible materials such as moisture barriers or insulation to the composite sheet.

The embodiments of the present invention differ from the prior art of fastening through the development of a reusable fastening system with a torqueing clamp that increases the distribution of pressure to a hook along one side of the clamp face. This approach increases the clamping pressure while protecting the material being clamped by allowing the whole edge of the hook as the surface of the clamping pressure. In addition there is an integrated attachment mechanisms for mounting accessories with variable rotational optionality.

The first element is the torqueing clamp design, this may come integrated with a bolt which increases the torqueing effect. The lock is created by making a hole in one or more rigid materials and putting the bolt through the hole. The clamp face is at right angles to the bolt and has one side with a raised edge known as the hook followed by a groove. As the bolt is passed through the hole/s the clamp will be pulled flush with the rigid material. At the same time a threaded nut is tightened on the other side of the rigid material.

As the nut is tightened on the clamp the linear force generated will press the raised edge or hook of the clamp against the rigid material first, creating torque pressure around the axis of the 90 degree angle from the leading edge to where the bolt joins the clamp face. This distributes all of the linear thread pressure generated to the raised edge of the clamp where the force is applied based on the distance of the moment arm from where the bolt base to the hook. As the plastic elastically deforms and bends, the opposite side of the clamp face to the hook, known as the contact edge will eventually be pulled into contact with the rigid surface. This action stops the clamp/bolt joint failing due to non-elastic deformation or failure. Additional tightening of the nut past this point will increase the linear force and distribute it unequally with the hook receiving more. Because there is a groove following the raised edge it is possible to trap a seam or hem capturing a range of flexible materials securely in place against the rigid materials. Because the raised edge has strong pressure over a larger area (teeth could be added to reduce surface area and increase the local pressure) and because the groove trapping material seams further enhances the clamping effect the clamping action is much less destructive on the materials being clamped.

The nut has a flange to increase the static friction, provide a counter force to the clamp on the other side of the rigid material and protect the material from potential tearing or folding. The nut has an internal thread and an external shape suitable for a wrench to aid users in tightening. The back of the nut may have a safety dome to protect user from the tip of the bolt or a plug to act as a receiver for any socket accessory.

The bolt for children is designed to be self-piercing for corrugated cardboard, yet with a safety tip for skin. The clamp face has a large surface area to ensure a secure lock and reduce any potential tearing or folding of the rigid corrugated cardboard material. The thread has a sharp leading edge which facilitates clearing material when tightening so it is not fouled with fibers.

The back of the clamp face along with the back side of the nut provide the opportunity to have an integrated embodiment of the male half of the attachment system, the plug. The attachment system will then be firmly and securely attached to the rigid material via the clamp, allowing items with the female half of the attachment system, the socket to be easily attached and detached.

The plug and socket share are designed to work together and deliver some unique properties. The split plug design varies from a normal split plug in two ways. The first is that while there are opposing flexible splits with a rounded lip for the snap fit, there is also a solid core to the plug without a lip as the barrel is rigid. The benefit of the rigid barrel is that when the socket rotates even large amounts of pressure placed on the plug/socket will not damage the flexible splits as they are held against the rigid core. The rigid core has space for a longitudinal bore through the center to be used to transfer either transverse or rotational motion. The plug also has teeth like a gear at its base. These teeth can be used by the socket to optionally constrain rotation around the longitudinal axis of the plug. If the socket has no teeth then it will spin freely on the socket. If the socket has a set of reverse teeth then it can be placed at any angle divisible by the number of teeth and remain fixed. If the socket has a flexible lever the socket can be rotated in steps. The firmness of the lever determines the force required to jump over a plug tooth and can be varied based on the sockets requirements.

A variety of hinges can be constructed to join two different rigid materials each with its own clamp. This can be via a socket and plug 'towball' or by using a claw and rod hinge built into the side of each clamp.

The transfer versions of the clamp+nut combination both have plugs on the back with a longitudinal bore through the center creating a bore hole. Then transfer sockets can be attached to the plugs on either side. These can have a splined axle inserted between them locking them rotationally.

As accessories to the locking, clamping and attachment properties of this fastening system, an I-Beam is used with slots to allow the clamp groove to asymmetrically align with the flange on the I-Beam producing a very solid lock. The I-Beam can be straight or bent at angles to allow two separate rigid materials to be clamped side by side or at an angle. An additional accessory is a wrench to make tightening nuts easier, along with a safety tipped bolt on the handle to make creating holes of the correct diameter easier. An additional accessory is a plastic safety serrated pull blade for cutting slots in cardboard. The kerf of the blade matches the standard corrugated cardboard thickness.

The attachment system can be extended with converters, these include a locking socket and plug at 90 degrees, a plug back to back with a plug to convert a socket into a plug, a socket and plug back to back to extend and a socket back to back with a socket to convert a plug into a socket.

To allow users to create their own customized rotating socket accessories such as a car steering wheel or airplane propeller the socket clamp allows a user to cut corrugated card or other rigid material into a desired shape and fix at the desired center of rotation the socket clamp. Now this accessory can be quickly attached and detached from any plug.

An additional accessory is a smartphone mount which allows its front facing camera to see augmented reality markers on accessories like a steering wheel and throttle. The smartphone can then compute the position and rotation of those markers and hence the accessories in real time allowing them to be used a digital inputs for the smartphone game.

For fastening use cases such as construction and packaging there are modified versions of the clamp and nut which suit specific locking and clamping challenges.

The standard version of the clamp and nut is identical but may be made different sizes and removes the safety and attachment features.

The expanding sleeve version is a specialized variant of the nut which friction fits the inside of a drilled hole. The sleeve has external ridges to hold onto the rigid material under pressure and threads on the inside to receive the plastic bolt. Because the clamp cannot rotate the bolt must be separated from the clamp and hence the torque effect is reduced to the radius of the head of the bolt rather than the radius of the clamp. Further, the hole in the clamp could be moved closer to the groove and the raised edge in the clamp to further increase the pressure asymmetry favoring the raised edge. As a further specialization a onetime use cutting tooth system could be added to the end of the bolt to allow it to drill its own hole into softer rigid materials such as cardboard.

The clamp with the hole could be further beveled and used with a normal metal wood screw when locking and clamping rigid and flexible materials against a building material such as wood. The bevel assists in providing a flush fit for the head of the screw. As in the separate bolt example the screw will provide off center pressure only based on the radius of the screw head, so this could also be further enhanced by moving the beveled hole closer to the clamp groove and leading edge.

Finally a specific variation for fastening cardboard boxes from the outside can be constructed. The box flaps should overlap and have either pre-punched holes that line up, or a hole can be drilled through both when closed. Then the threaded torque clamp is clipped into place under the bottom cardboard flap. The friction pins will be forced into the card as the clip length should match the card thickness. The pins prevents rotation during the initial tightening. Then the box is closed and the finger drive bolt is inserted through the hole in the top flap and then into the aligned threaded torque clamp in the bottom flap. The bolt can be turned by hand or with an electric torque wrench clamping the box.

FIG. 1A shows, in accordance with an embodiment of the present invention, a side view of a torqueing clamp 103, having a threaded bolt 111 with a safety tip 113, for locking together sheets of corrugated cardboard or other rigid materials. The clamp 103 also has a head that includes the clamp face 123 and the parallel clamp back. FIG. 1A shows the torqueing clamp 103 positioned to have its safety tip 113 pressed through the corrugated cardboard 105 of FIG. 1B, in accordance with an embodiment of the present invention. In other embodiments, the safety tip 113 may be pressed through other rigid sheet materials. When pressed through the cardboard 105, the safety nut 101, with a large flange 117, of FIG. 1C is tightened on the threaded bolt 111 on the other side of the cardboard 105, and the threaded bolt 111 interlocks with the internal thread 119 of the nut 101. The nut 101 and the large flange 117 increases friction of the nut 101, spreading the pressure caused by the pressure generated between the nut 101 and the inserted clamp 103 as they are tightened together and strengthening the cardboard joint by providing a larger rigid surface area to support the pressure generated by the clamp hook 107.

The torqueing clamp 103 of FIG. 1A is designed to lock together rigid materials, such as the cardboard 105 of FIG. 1B, and requires a hole the diameter of the threaded bolt 111 to provide such lock. The torqueing clamp 103 can also optionally clamp flexible materials non-destructively with its trough 109 and hook 107, as shown in FIG. 1A.

FIG. 1B shows, in accordance with an embodiment, two sheets of corrugated cardboard 105 positioned to be locked together by placing the bolt 111 through a hole made in one side of the cardboard 105 by the bolt's safety tip 113. FIG. 1C shows, in accordance with an embodiment of the present invention, the safety nut 101 tightened on the end of the bolt 111 placed through the hole and emerged at the other side of the cardboard 105.

As shown in FIG. 1A, the clamp 103 has a clamp face 123 that is a flat plane. When the nut 101 is attached to the bolt 111, the clamp face 123 is parallel with the circular flange 117 of the nut 101, shown in FIG. 1C, which is also a flat plane, although circular in shape, to reduce catching and tearing the rigid material being locked and clamped. The longitudinal axis 110 of the bolt 111, shown in FIG. 1A, is positioned at a right angle to the clamp face 123 and circular flange 117 of the nut 101.

As also shown in FIG. 1A, the hook/outer edge 107 of the clamp face 123 is raised from the surface of the clamp face 123 by a hook height 106. The trough 109 of the clamp face 123 is lowered from the surface of the clamp face 123 by a trough depth 108. The circumferential position of the clamp face having the hook 107 and trough 109 is also referred to herein as the gripping region. The opposing circumferential position of the clamp face is also referred to herein as the leverage region. The bolt 111 of the clamp 103 has an optional safety tip 113 that reduces the its surface area enough to allow moderate pressure to penetrate the cardboard 105, but not human skin, during insertion, thereby removing the need to drill or otherwise make holes in cardboard 105 so as to remain safe.

FIG. 1C shows the safety nut 101 having a safety dome 115, which restricts the length that the optional safety tip 113 can extend through the internal thread 119 of the nut 101. The nut 101 also has faces 121 which allow a spanner or wrench to clamp and rotate the nut 101 for tightening to the bolt 111.

FIG. 2A shows, in accordance with an embodiment of the present invention, the torque clamp 103 under light pressure 201 during a first state of insertion into the cardboard 105 of FIG. 1B. In this state, the clamp face 123 is not in contact with the cardboard 105. The force along the longitudinal axis 110 of the bolt 111, along the lever arm length r 206, is purely caused by the hook 107 of the clamp 103 against the cardboard 105. The clamp face 123 does not contact the cardboard 105 until the force along the longitudinal axis 110 deforms the angle of the clamp face 123 by α alpha 204.

Figure 2B:
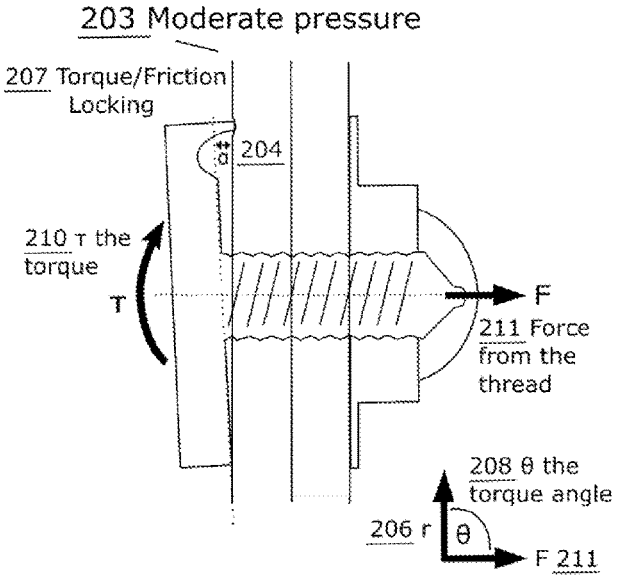
FIG. 2B shows, in accordance with an embodiment of the present invention, the torque clamp of FIG. 1A under moderate pressure during insertion into the cardboard sheets of FIG. 1B, where most of the force applied by the thread where the nut is tightened and is transferred to the hook/outer edge of the clamp.

FIG. 2B shows, in accordance with an embodiment of the present invention, the torque clamp 103 under moderate pressure 203 during a second state of insertion into the cardboard 105, where most of the force applied by the threaded bolt 111 and nut 101 combination is transferred to the hook/outer edge 107 of the clamp 103. In FIG. 2B, the force 211 created by the nut 101 and bolt 111 acts along the bolt's longitudinal axis 110 and brings the clamp face 123 in contact with the cardboard 105. Theta θ 208 describes the torque angle which is 90 degrees. The torque angle 208 is the angle described by a line parallel to the clamp face 123 and a line along the longitudinal axis 110 of the bolt 111. This right angle provides the maximum torque on the hook 107. The leverage of the torque is increased by the length of the lever arm 206. The reduced surface area of the hook 107, as a thin edge, increases the pressure on the cardboard 105. This pressure locks this rigid material 105 together and prevents rotation while supporting the clamping of flexible materials, such as shown in FIG. 3B, between the hook 107 and the surface of the rigid material 105. Materials with a seam, as in FIG. 3B, are ideal as the seam can rest in the trough 109 of the clamp face 123, which blocks the material from pulling through the hook 107.

The surface area of the hook 107 can be reduced further and the pressure per area increased by adding teeth or ridges to the hook 107. Such addition of teeth or ridges would be recommended for embodiments with flexible materials having high tensile strength and puncture resistance, and not for woven materials or textiles in general.

As shown in FIG. 2B, the Tau τ torque 210, or moment of force around the point where the bolt 111 joins the clamp face 123, is calculated at the moment the hook 107 contacts the cardboard 105 as $\tau = r*F*\sin(\theta)$. The material (e.g., metals or plastics) used to manufacture the clamp 103 and bolt 111 combination determines the moment of inertia based on respective stiffness and elastic deformation. This moment is determined based on a combination of the physical properties of the clamp and current environment, and includes the temperature and the dimensions and profile of the clamp material and the material's elastic modulus.

α alpha 204 of FIG. 2B is the angle defined by the plane of the clamp face 123 and an imaginary plane from the two outer edges of the clamp 103—one outer edge on the clamp plane and the other outer edge along the edge of the raised hook 107. α alpha 204 is the amount of rotational deformation allowed before some pressure will be distributed to the edge of the clamp face 123, away from the hook 107, as illustrated by 207.

The hook height 106 from the claim face 123 and face dimensions determine the α alpha 204 max deformation angle. The α alpha 204 max deformation angle can be set to maximize the Tau τ torque 210, which can be transferred before the material from which the clamp and bolt combination is manufactured fails and is no longer elastically deformed. If the material has not failed, once the α alpha max 204 deformation angle is reached, the final locking force on the hook 107 is the combination of the force applied to reach the α alpha max 204 deformation angle. In this situation, the further force applied along the longitudinal axis 110 of the bolt 111 is unevenly distributed about a new moment of force around the opposite edge of the clamp face 123 from the hook 107, from where α alpha 204 is measured. The geometric configuration of the hook height 106 and the dimensions of the clamp 103 will determine such distribution ratio, but such configuration will always cause more force to be distributed on the side of the hook 107 vs the edge of the clamp face 123.

Figure 2C:
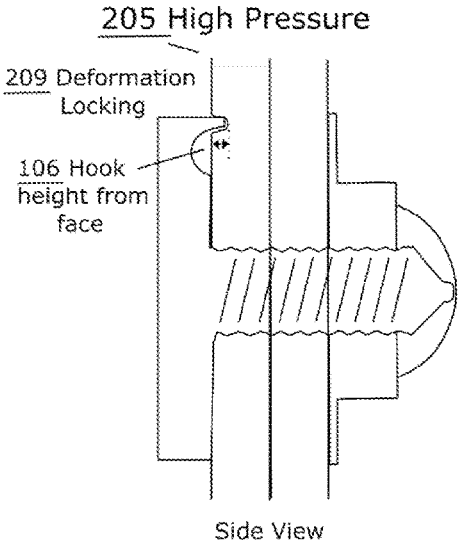
FIG. 2C shows, in accordance with an embodiment of the present invention, the torque clamp of FIG. 1A under high pressure during insertion into the cardboard sheets of FIG. 1B and where the nut it tightened, where the cardboard surface deforms locking the clamp into the cardboard.

FIG. 2C shows, in accordance with an embodiment of the present invention, the torque clamp 103 under high pressure 205 during a third state of insertion into the cardboard 105 where the force applied by the threaded bolt 111 and nut 101 combination deforms the cardboard surface locking the clamp hook 107 into the cardboard 105. Here the hook 107 of the clamp 103 is trapped inside the deformed rigid material 105 to a depth of the hook height 106 from the face 123. In this embodiment, the torqueing force is negated and the pressure is evenly distributed over the clamp face 123. However the clamp 103 is now prevented from rotating due to the hook 107 being trapped by deformation locking 209. In addition, any flexible material clamped under the hook 107 is now equally trapped in place.

Figure 3A:
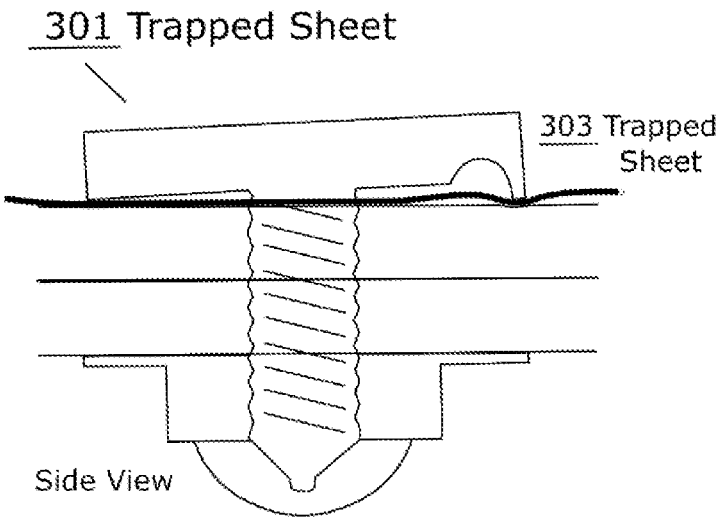
FIG. 3A shows a mechanism of clamping a sheet material to the cardboard sheets of FIG. 1B by penetrating only a small hole in the cardboard sheet and material to be clamped to accommodate the bolt, in accordance with an embodiment of the present invention.
Figure 3B:
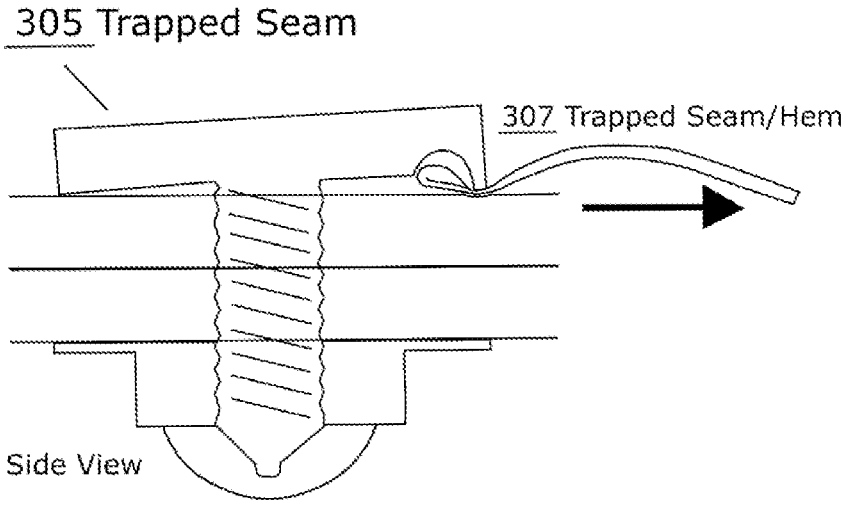
FIG. 3B shows a mechanism of non-destructively clamping a material with a seam to the cardboard sheets of FIG. 1B without any need for a hole or damage to the material, in accordance with an embodiment of the present invention.

FIG. 3A shows a mechanism 301 of clamping a sheet material 301 to the cardboard 105 by penetrating only a small hole in the cardboard and the material to accommodate the bolt, in accordance with an embodiment of the present invention. This clamping mechanism traps the sheet material 303 under the hook 107 of the claim 103.

FIG. 3B shows a mechanism 305 of non-destructively clamping a material with a seam 307 to the cardboard 105 without the need for puncturing a hole or causing other damage to the material, in accordance with an embodiment of the present invention. Using this mechanism, the trough 109 of the clamp 103 holds and traps a seam, hem, or lip 307 of a plastic, paper, or cloth material being clamped to the cardboard 105.

Figure 4A:
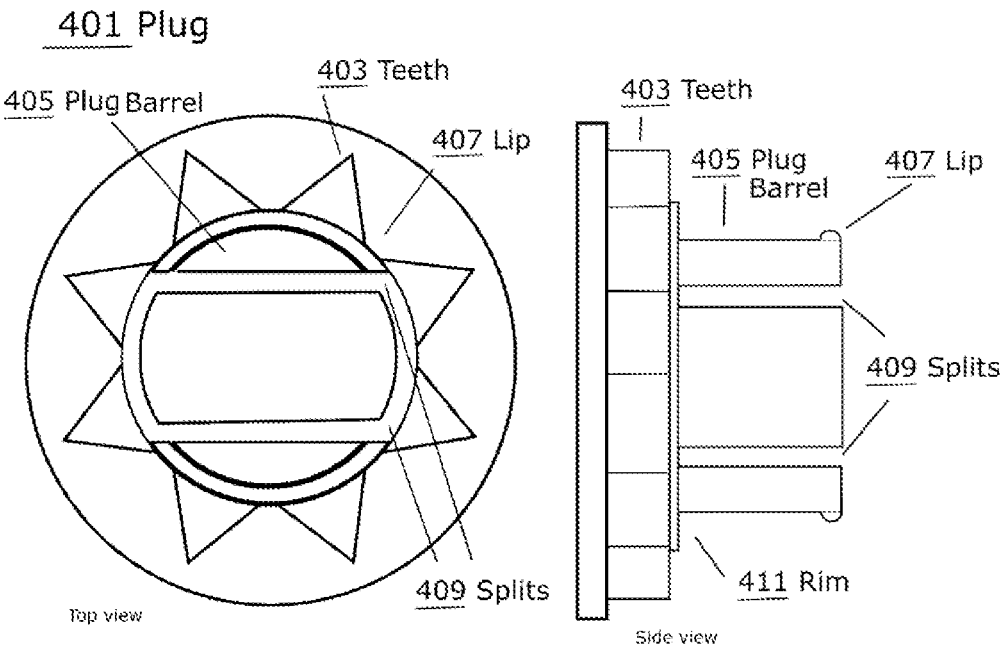
FIG. 4A shows a top view of a plug, which can be mounted on the back of the clamp of FIG. 1A, that has teeth for locking onto the clamp 103 and a split barrel for mounting, onto the plug, accessories having a socket of type in FIG. 5A, FIG. 5B or FIG. 5C, in accordance with an embodiment of the present invention. In embodiments, the plug is manufactured to be integral with the clamp 103.

FIG. 4A shows a top view of a plug 401, which can be mounted on the back of the clamp 103, that has teeth 403 for locking onto the clamp 103 and a split 409 barrel 405 for mounting, onto the plug 401, accessories, in accordance with an embodiment of the present invention. The accessories may have a socket of type in FIG. 5A, FIG. 5B or FIG. 5C for mounting to the plug 401. The plug 401 is based on a standard split pin concept that is modified to provide much higher strength and rigidity for accessories mounted to the plug 401 to rotate smoothly around the barrel 405 by adding a fixed center element. This modified split pin concept also stops any over compression of the two flexible sides of the plug 401 by each split 409 being equal to the plug's lip 407 width. The lip 407 is only present on the flexible sides of the plug 401, as these sides must deform to allow the barrel of a socket, attached to an accessory being mounted to the plug 401, to fit over the plug barrel 405 and lock into place. The barrel of the socket is beveled to both ease the pressure on the lip 407 during insertion into the plug's barrel 405 and to hold the lip 407 when the socket is in place attached to the plug 401. There is a rim 411 at the bottom of the plug 401 to support free rotation for embodiments of sockets designed to spin. Below the rim 411, the plug 401 has triangle lock teeth 403 so that a socket with reverse teeth at the bottom of the socket's barrel can be clipped into place at each of a set of fixed orientations. Constructed of a flexible plastic, such as PLA, PETG or ABS, one or more flexible click levers can be attached to the barrel of the socket to engage one or more of the teeth on the plug. This allows the socket to be rotated under pressure when clicked into a position onto the plug 401. The flexibility of the one or more levers on the socket allows adjustment of the rotational force required to change positions. Levers can be vertical or horizontal to the teeth on the plug.

The plug is designed to be manufactured on the back of a clamp. This is critical as it allows very accurate positioning and stability in attaching the plug onto a corrugated cardboard box or sheet.

Figure 4B:
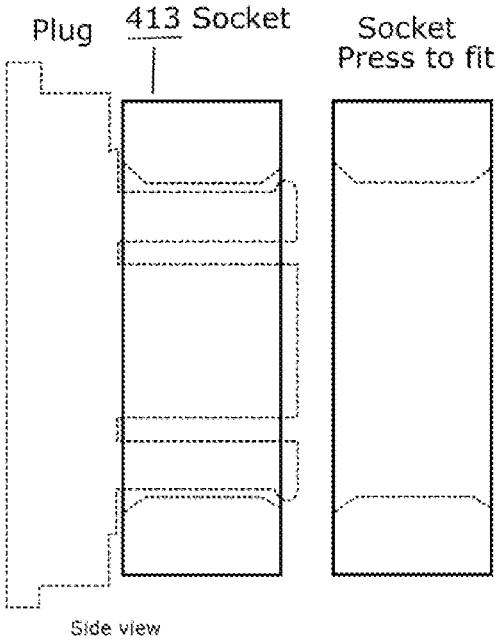
FIG. 4B shows a mechanism of mounting a socket accessory onto the plug of FIG. 4A, in accordance with an embodiment of the present invention. In the embodiment of FIG. 4B, the lips of the plug are too large to fit the socket which causes the flexible ends of the plug's split to bend inwards, and then snap back into shape when the socket is fully mounted. Pressure on the plug is required to then remove the socket from the plug and reverse the process, in accordance with an embodiment of the present invention.

FIG. 4B shows a mechanism of mounting a socket accessory onto the plug 401 of FIG. 4A, in accordance with an embodiment of the present invention. FIG. 4B includes an accessory socket 413, in accordance with an embodiment of the present invention, that can be attached and detached from the plug 401 solidly mounted to the clamp 103. In the embodiment of FIG. 4B, the lips of the plug 401 are too large to fit the socket, causing the flexible ends of the plug's split 409 to bend inwards, and then snap back into shape when the socket is fully mounted. Pressure on the plug 401 is required to then remove the socket from the plug 401 and reverse the process, in accordance with an embodiment of the present invention.

Figure 5A:
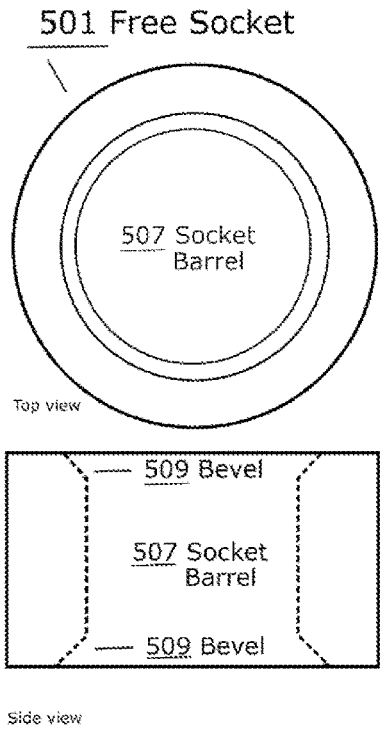
FIG. 5A shows a free socket, in accordance with an embodiment of the present invention, configured for free rotation about the plug of FIG. 4A. The free socket of FIG. 5A does not have teeth, so when mounted to the plug, the socket does not engage the plug's teeth so as to allow free rotation.

FIG. 5A shows a free socket 501, in accordance with an embodiment of the present invention, configured for free rotation about the plug 401. The free socket 501 has a barrel 507 that is beveled 509 to accept the plug's lip 407. The free socket 501 does not have teeth, so when mounted to the plug 401, the socket 501 does not engage with the plug's teeth 403 so as to allow free rotation.

Figure 5B:
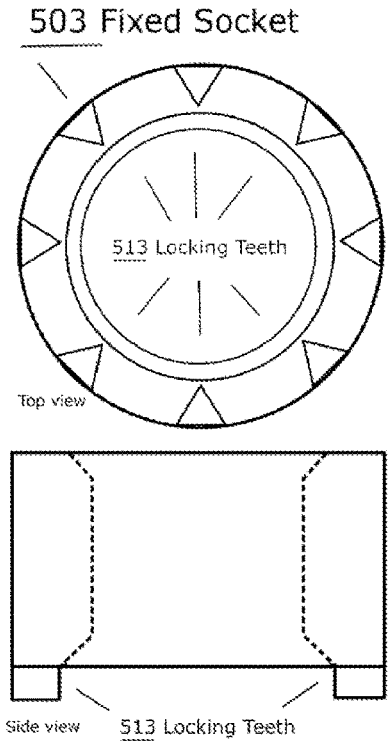

FIG. 5B shows a fixed socket 503, in accordance with an embodiment of the present invention, configured for locked rotation about the plug 401. When mounted on the plug 401, the locking teeth 513 of the fixed socket 503 engage with the matching plug's teeth 403 allowing the socket 503 to be applied in any symmetrical angle allowed by the teeth count, but to be fixed once locked in place to the plug 401, so as to cause locked rotation.

Figure 5C:
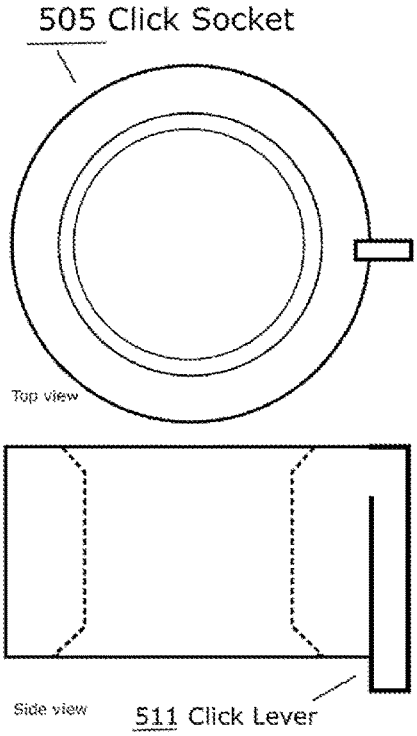
FIG. 5C shows a click socket, in accordance with an embodiment of the present invention, configured for variable stepped rotation about the plug of FIG. 4A. The click socket of FIG. 5C has a flexible click lever, so when mounted to the plug, the lever engages one or more of the plug's teeth so as to advance or reverse the socket under rotational pressure around the barrel of the plug in an indexed stepping motion.

FIG. 5C shows a click socket 505, in accordance with an embodiment of the present invention, configured for variable rotation about the plug 401. When the socket 505 is mounted on a plug 401, the flexible click lever 511 of the socket 505 engages one or more of the plug's teeth 403 so as to advance or reverse the socket 505 under rotational pressure around the barrel 405 of the plug 401 in an indexed stepping motion.

Figure 6:
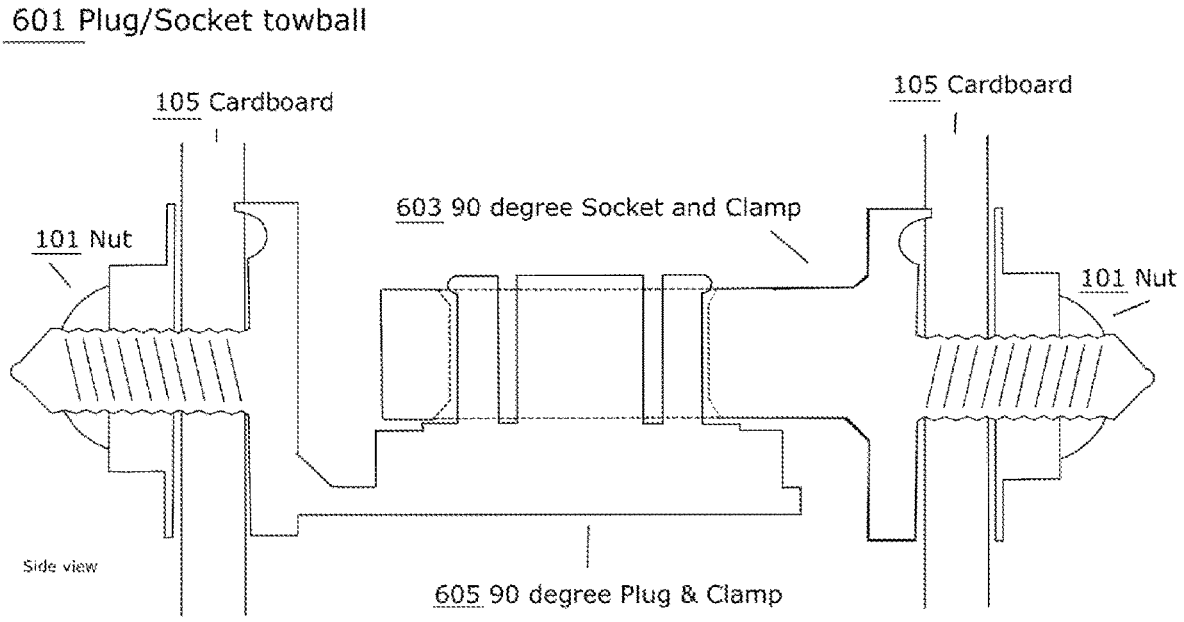
FIG. 6 shows, in accordance with an embodiment of the present invention, a plug connected to a clamp at ninety degrees. The clamp is clamped to one piece of cardboard with a nut.

FIG. 6 shows, in accordance with an embodiment of the present invention, a plug connected to a clamp at ninety degrees. The clamp is clamped to one piece of cardboard with a nut 101. FIG. 6 also shows a socket connected to a clamp at ninety degrees. The clamp is clamped to another piece of cardboard with a nut 101. The plug 605 and socket 603 are then connected to create a rotating joint that forms a towball 601 style hinge where the socket 603 can be attached or removed from the plug 605 to connect or disconnect the two surfaces 105 in accordance with an embodiment of the present invention.

Figure 7:
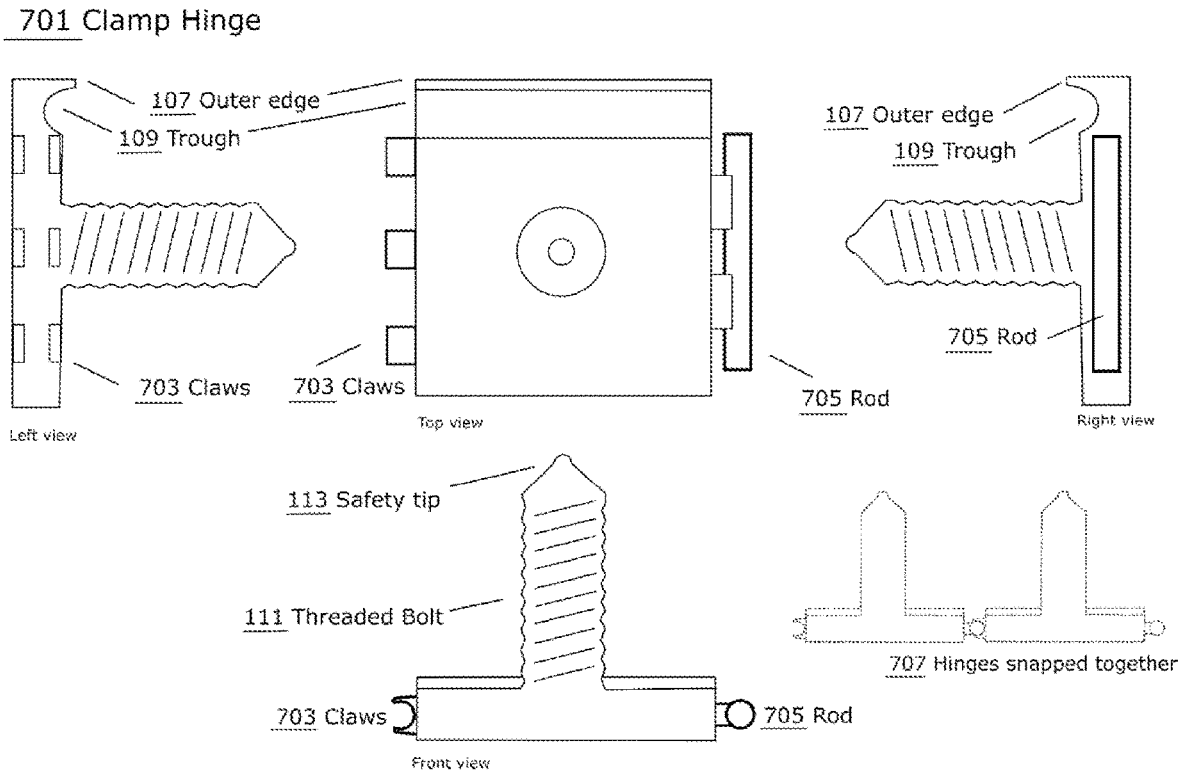
FIG. 7 shows two clamps being pressure fit together as a hinge along their side using a rod and claw mechanism, in accordance with an embodiment of the present invention. The rod on one side of the clamp is locked into one or more claws on the other side of another clamp where the two clamps rotate around the axis of the rod, in accordance with an embodiment of the present invention.

FIG. 7 shows two clamps 701 being pressure fit together as a hinge along their side using a rod and claw mechanism. The rod 705 on one side of the clamp is snapped 707 into one or more claws 703 on the other side of another clamp where the two clamps can rotate around the axis of the rod 705 in accordance with an embodiment of the present invention. The clamps still retain the existing hook/outer edge 107, trough 109, threaded bolt 111 and safety tip 113.

Figure 8A:
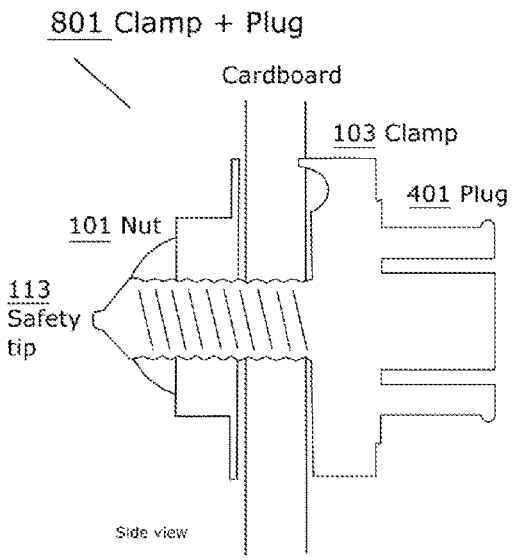
FIG. 8A shows a standard clamp and plug screwed into a nut, in accordance with an embodiment of the present invention.

FIG. 8A shows a standard clamp and plug 801 screwed into a nut 101, in accordance with an embodiment of the present invention. The clamp and plug 801 contains both a clamp 103 with a bolt and safety tip 113 and a plug 401.

Figure 8B:
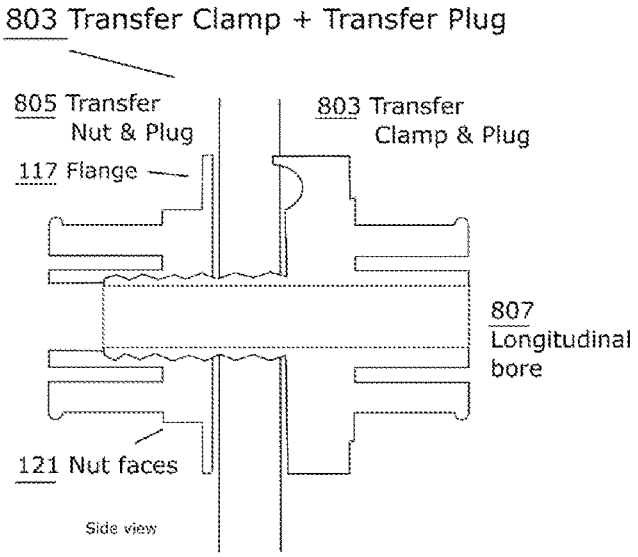
FIG. 8B shows the nut of FIG. 8A replaced with a transfer (hollow) nut which is also a plug, in accordance with an embodiment of the present invention. The clamp and plug on the other side are also of transfer type (hollow). In accordance with an embodiment of the present invention, these two parts can be screwed together.

FIG. 8B shows the nut of FIG. 8A replaced with a transfer (hollow) nut which is also a plug 805. The transfer nut and plug 805 retains the nut flange 117 and nut faces 121 for tightening. The clamp and plug 803 on the other side is also of the transfer type (hollow) with a longitudinal bore 807. In accordance with an embodiment of the present invention, these two parts can be screwed together.

Figure 8C:
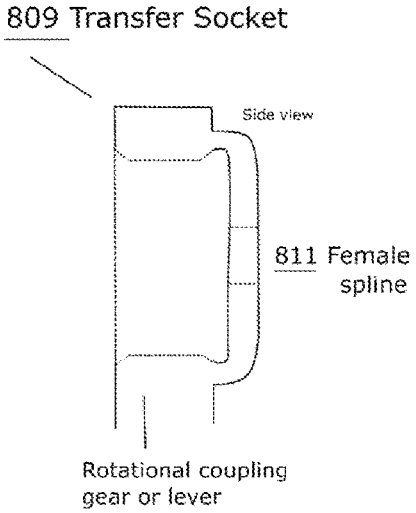
FIG. 8C, in accordance with an embodiment of the present invention, is a transfer socket with a female spline to receive an axle.

FIG. 8C in accordance with an embodiment of the present invention is a transfer socket 809 with a female spline 811 to receive an axle.

Figure 8D:
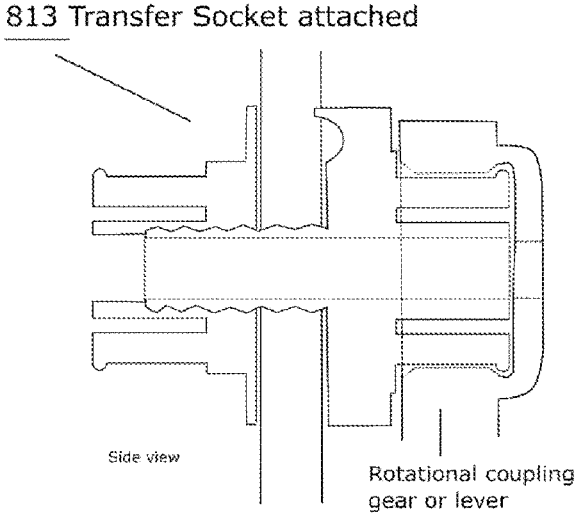
FIG. 8D shows the transfer socket attached to the plug clamp of FIG. 8B combination, in accordance with an embodiment of the present invention.

FIG. 8D shows the transfer socket attached to the plug clamp of FIG. 8B combination, in accordance with the embodiment of the present invention.

Figure 8E:
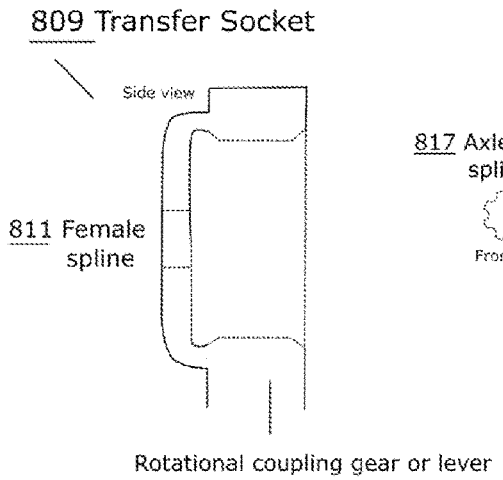
FIG. 8E shows another transfer socket with a female spline to receive an axle and an axle, in accordance with an embodiment of the present invention.

FIG. 8E shows another transfer socket 809 with a female spline 811 to receive an axle and an axle 817, in accordance with the embodiment of the present invention.

Figure 8F:
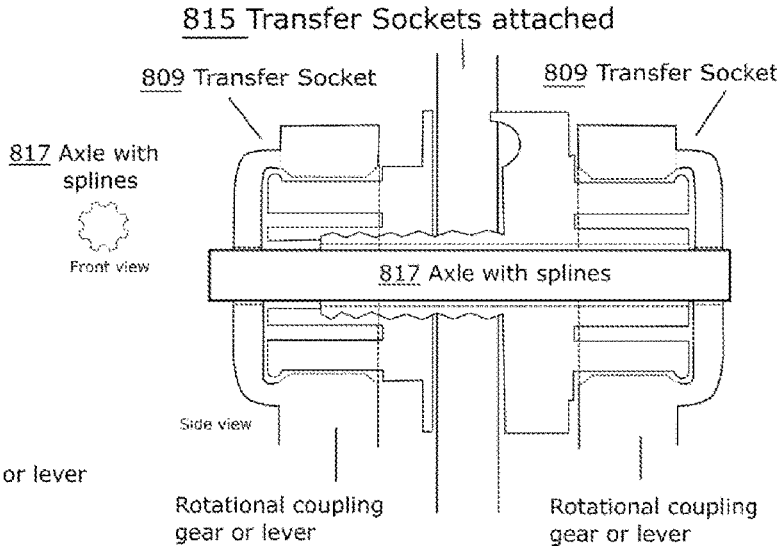
FIG. 8F shows the second transfer socket attached to the plug nut combination from FIG. 8D, in accordance with an embodiment of the present invention. The axle then is inserted coupling both sockets with rotation at right angles to the plane of the clamped cardboard, in accordance with an embodiment of the present invention.

FIG. 8F shows the second transfer socket 809 attached to the plug nut combination from FIG. 8D. The axle 817 then is inserted coupling both sockets with rotation at right angles to the plane of the clamped cardboard, in accordance with an embodiment of the present invention.

Figure 9:
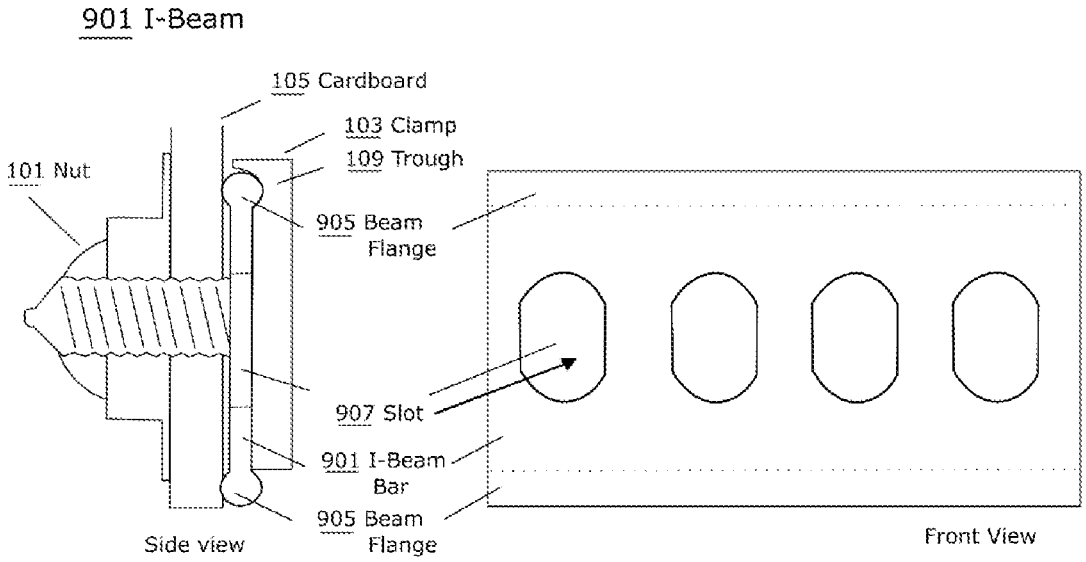
FIG. 9 shows an I-Beam, in accordance with an embodiment of the present invention, that is designed to receive clamps with slots for the bolts of the clamps and a beam flange designed to couple with the trough in the clamps to join together two separate boxes or sheets of card side by side.

FIG. 9 shows an I-Beam 901, in accordance with an embodiment of the present invention, that is designed to receive clamps 103 with slots 907 for the bolts 111 of the clamps and a beam flange 905 designed to couple with the trough 109 in the clamps to join together two separate boxes or sheets of card side by side using nuts 101 to create the pressure. The I-Beam can be of any length required given it is manufactured from rigid enough material allowing a strong connection for multiple boxes or sheets to be assembled into new constructions.

Figure 10:
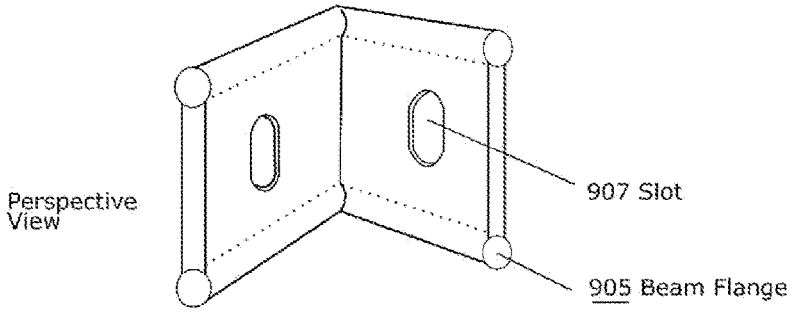
FIG. 10 shows an I-Beam with a 90 degree bend, in accordance with an embodiment of the present invention. This is designed to receive clamps with slots for the bolts of the clamps and a beam flange designed to couple with the trough in the clamps and can clamp together two boxes or sheets of card at a 90 degree angle.

FIG. 10 shows an I-Beam with a 90 degree bend 1001, in accordance with an embodiment of the present invention. This is designed to receive clamps 103 with slots 907 for the bolts 111 of the clamps and a beam flange 905 designed to couple with the trough 109 in the clamps and can clamp together two boxes or sheets of card at a 90 degree angle using nuts 101. The I-Beam can have a triangular gusset or other reinforcement to further strengthen the material providing a robust and accurate 90 degree angle for the sheet material to be connected to allowing multiple boxes or sheets to be assembled into new constructions.

Figure 11:
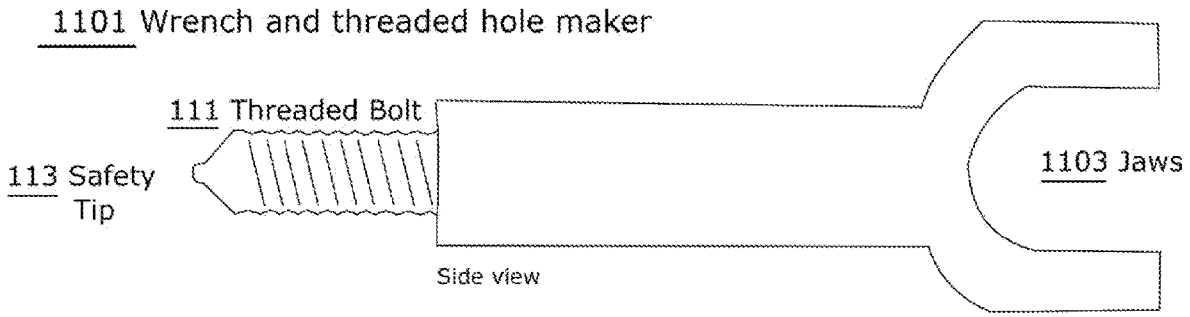
FIG. 11 shows a wrench, in accordance with an embodiment of the present invention, which has two primary uses, the first is to tighten any nuts, the second is to use the handle and the safety tipped bolt on the other end to apply more leverage to make holes in cardboard suitable to receive the clamp bolt.

FIG. 11 shows a wrench 1101, in accordance with an embodiment of the present invention, which has two primary uses, the first is to tighten any nuts using the jaws 1103 on the nut faces 121, the second is to use the handle and the safety tipped 113 bolt 111 on the other end to apply more leverage to make holes in cardboard suitable to receive the clamp bolt 111.

Figure 12:
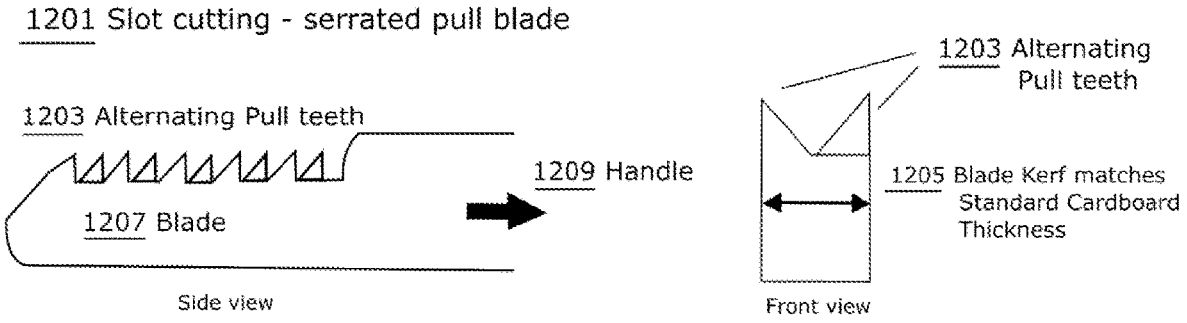
FIG. 12 shows a slot cutting serrated pull blade, in accordance with an embodiment of the present invention, as a safe way for people to cut slots the same kerf/width as cardboard by pulling the blade over the cardboard edge with pressure against the cardboard.

FIG. 12 shows a slot cutting serrated pull blade 1201, in accordance with an embodiment of the present invention, as a safe way for people to cut slots the same kerf/width as cardboard 1205 by using the handle 1209 to pull the blade 1207 composed of alternating teeth 1203 over the cardboard edge with pressure against the cardboard. These teeth tear the fibers in the cardboard at the outside edge resulting in a strip of card being removed the same width as the outside edges of the teeth.

Figure 13A:
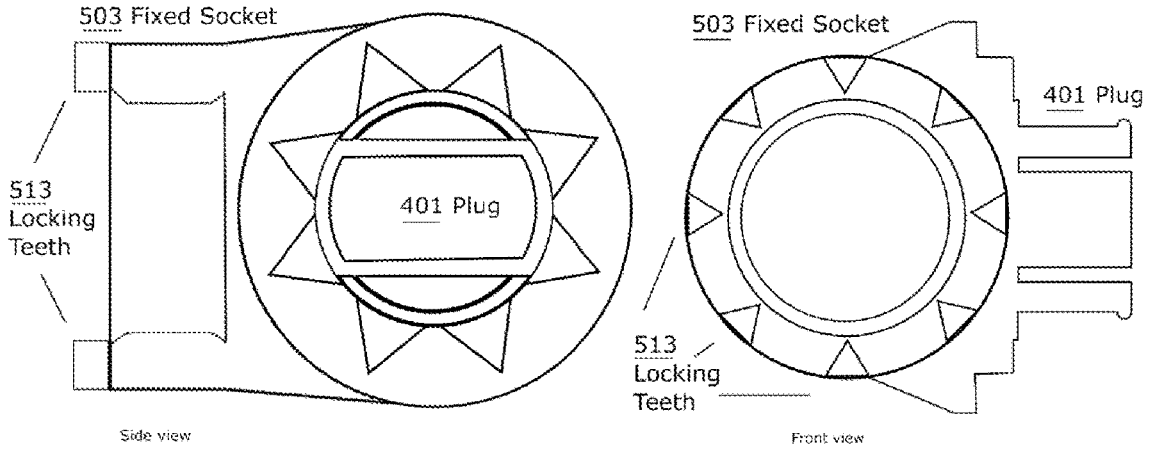
FIG. 13A shows, in accordance with an embodiment of the present invention, a locking socket and plug at a 90 degree angle. The socket is a locking socket so it can be connected to a plug in any selected axial angle matching the tooth count. This then provides the integrated plug at 90 degrees to the original plug.

FIG. 13A shows, in accordance with an embodiment of the present invention, a locking socket 503 and plug at a 90 degree angle 401. The socket has locking socket teeth 513 so it can be connected to a plug in any selected axial angle matching the tooth count. The socket plug 1301 hence provides the integrated plug 401 at 90 degrees to the original plug.

Figure 13B:
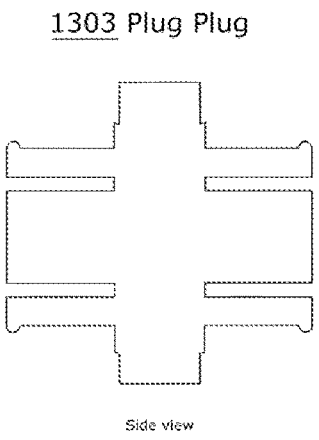
FIG. 13B shows, in accordance with an embodiment of the present invention, a plug that converts a socket into a plug.

FIG. 13B shows, in accordance with an embodiment of the present invention, a plug 1303 that converts a socket into a plug.

Figure 13C:
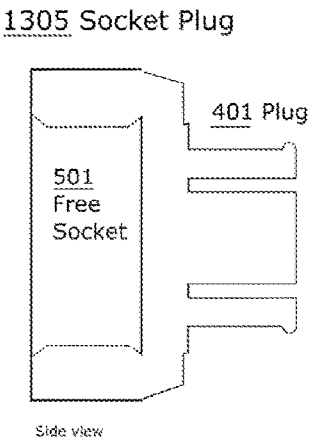
FIG. 13C shows, in accordance with an embodiment of the present invention, a socket plug to extend.

FIG. 13C shows, in accordance with an embodiment of the present invention, a socket plug 1305 to extend.

Figure 13D:
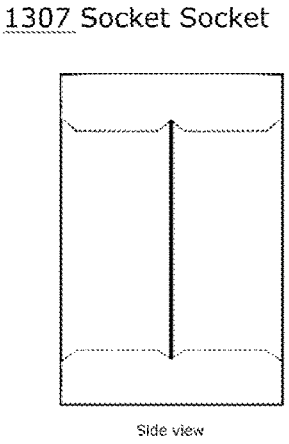
FIG. 13D shows, in accordance with an embodiment of the present invention, a socket to turn a plug into a socket.

FIG. 13D shows, in accordance with an embodiment of the present invention, a socket 1307 to turn a plug into a socket.

Figure 14A:
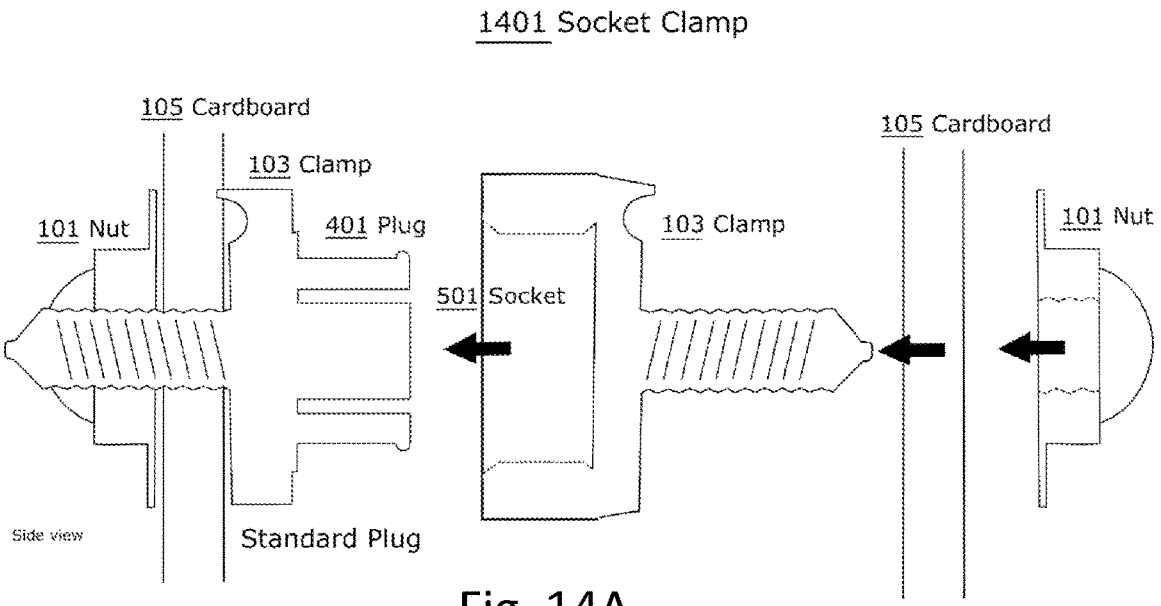
FIG. 14A shows the socket clamp elements which are used to create new and unique attachments such as a steering wheel or propeller out of cardboard or other materials in accordance with an embodiment of the present invention. It allows clamping any cardboard element onto a socket. Then the combined cardboard element and socket clamp can be rotated around the axis of the barrel of the plug.

FIG. 14A shows the socket clamp 1401 elements which are used to create new and unique attachments such as a steering wheel or propeller out of cardboard or other materials in accordance with an embodiment of the present invention. It allows a clamp 103 and nut 101 to affix any cardboard element 105 onto a socket 501. Then the socket can be attached to any mounted standard plug 401 and the combined cardboard element and socket clamp can be rotated around the axis of the barrel of the plug 401.

Figure 14B:
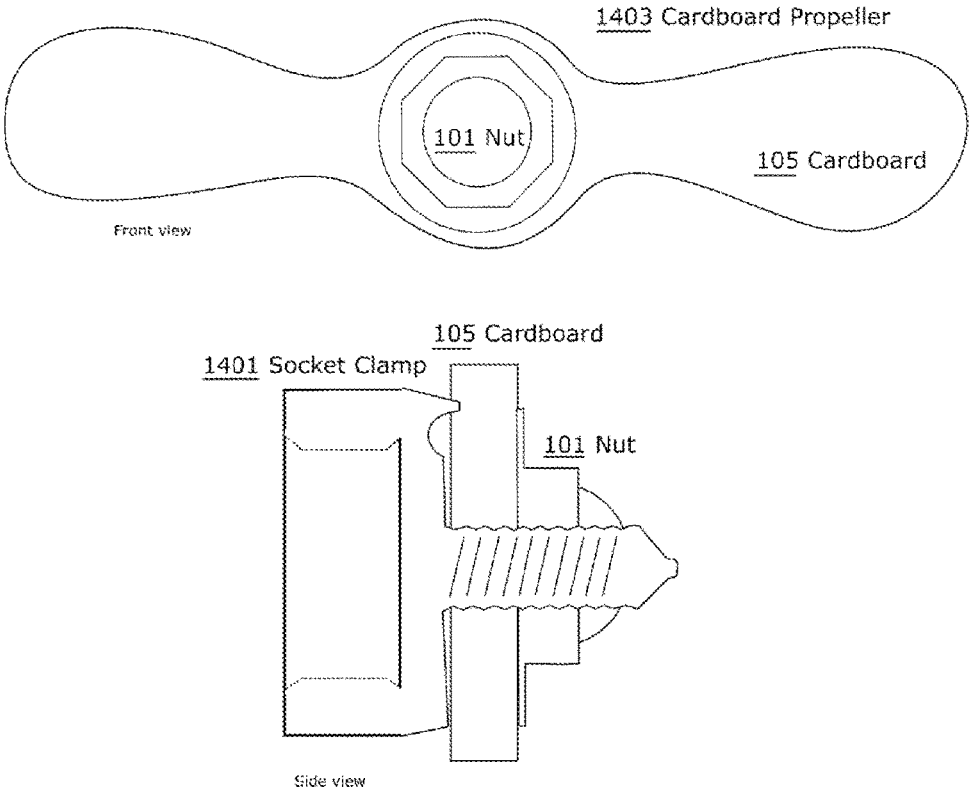
FIG. 14B shows a socket clamp combined with a nut and a cardboard propeller to make a unique prop which can be attached to a plug and rotated around its axis, in accordance with an embodiment of the present invention.

FIG. 14B shows a socket clamp 1401 combined with a nut 101 and a cardboard shape 105 to make a propeller 1403 which via the socket 501 can be attached to a plug and rotated around its axis, in accordance with an embodiment of the present invention.

Figure 15:
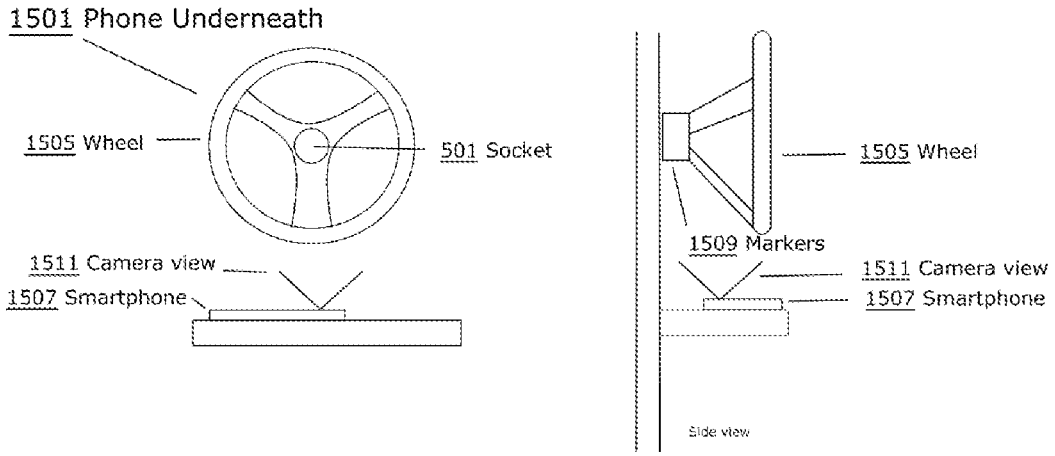
FIG. 15 shows a below arrangement for a smartphone to be able to recognize augmented reality markers on a steering wheel and optional throttle, in accordance with an embodiment of the present invention. This allows the smartphone software to recognize the position and orientation of the wheel and throttle just using the camera and with this information provide interaction for the user without any external electronics or sensors.

FIG. 15 shows a below arrangement for a smartphone 1507 to be able to recognize 1511 augmented reality markers 1509 on a steering wheel 1505 and optional throttle in accordance with an embodiment of the present invention. This allows the smartphone software to recognize the position and orientation of the wheel and throttle just using the camera and with this information provide interaction for the user without any external electronics or sensors.

Figure 16:
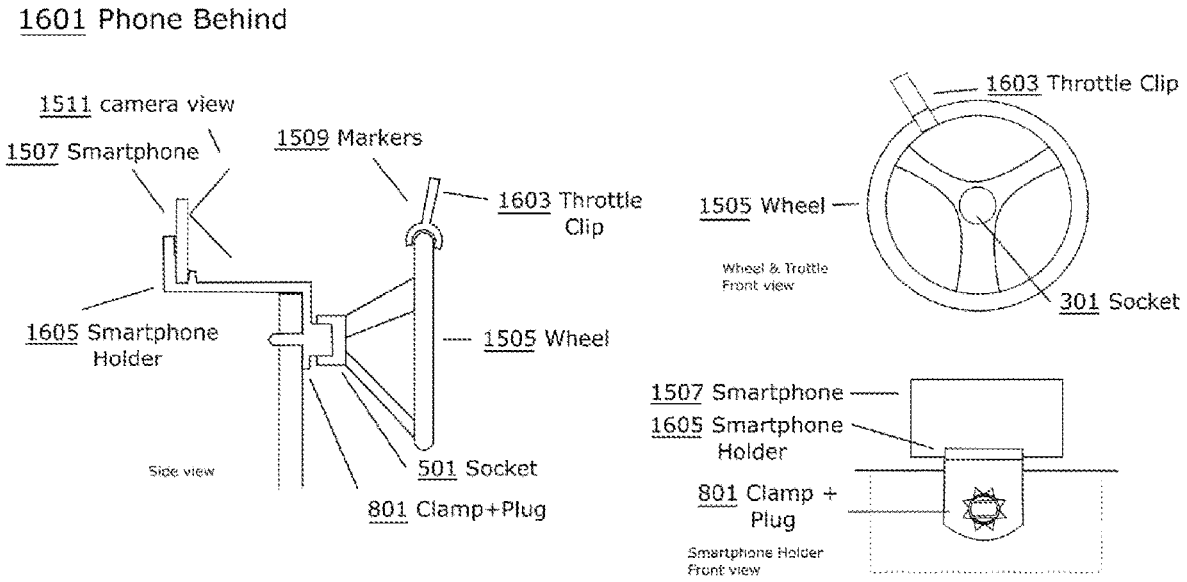
FIG. 16 shows a behind arrangement for a smartphone to be able to recognize augmented reality markers on a steering wheel and optional throttle, in accordance with an embodiment of the present invention. This allows the smartphone software to recognize the position and orientation of the wheel and throttle just using the camera and with this information provide interaction for the user without any external electronics or sensors.

FIG. 16 shows a behind arrangement for a smartphone 1507 to be able to recognize 1511 augmented reality markers 1509 on a steering wheel 1505 and optional throttle 1603, in accordance with an embodiment of the present invention. This allows the smartphone software to recognize the position and orientation of the wheel and throttle just using the camera and with this information provide interaction for the user without any external electronics or sensors.

Figure 17:
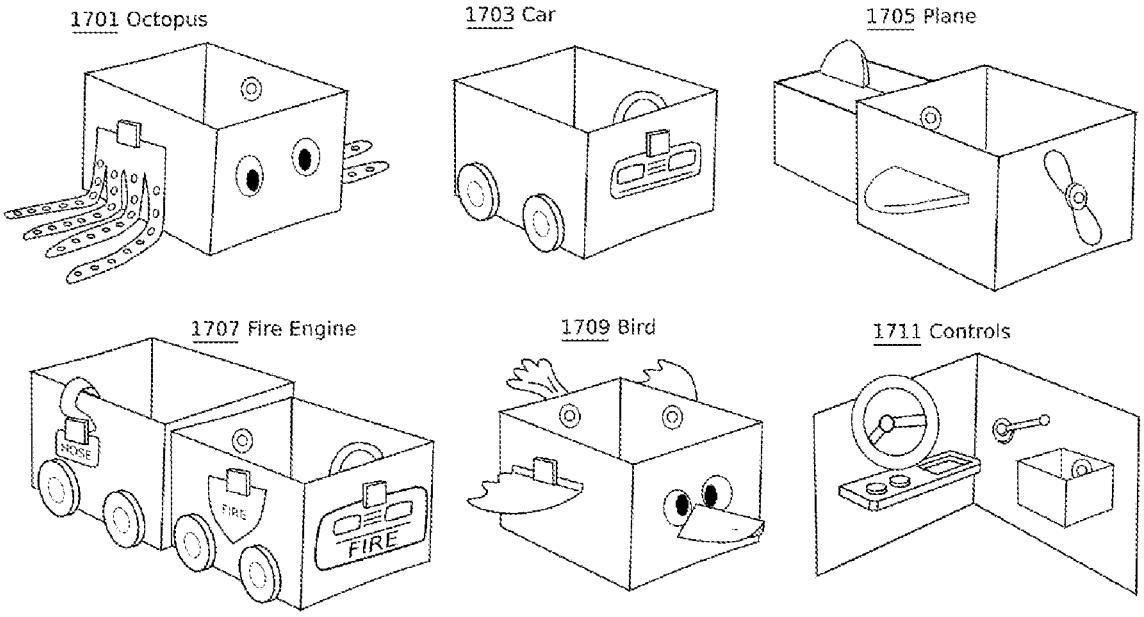
FIG. 17 shows six different examples of clamping cardboard, cloth and paper and attaching plastic props such as wheels, steering wheels and levers, in accordance with an embodiment of the present invention.

FIG. 17 shows six different examples of clamping cardboard, cloth and paper and attaching plastic props such as wheels, steering wheels and levers, in accordance with an embodiment of the present invention. The examples are an octopus 1701, car 1703, plane 1705, fire engine 1707, bird 1709 and controls 1711.

Figure 18:
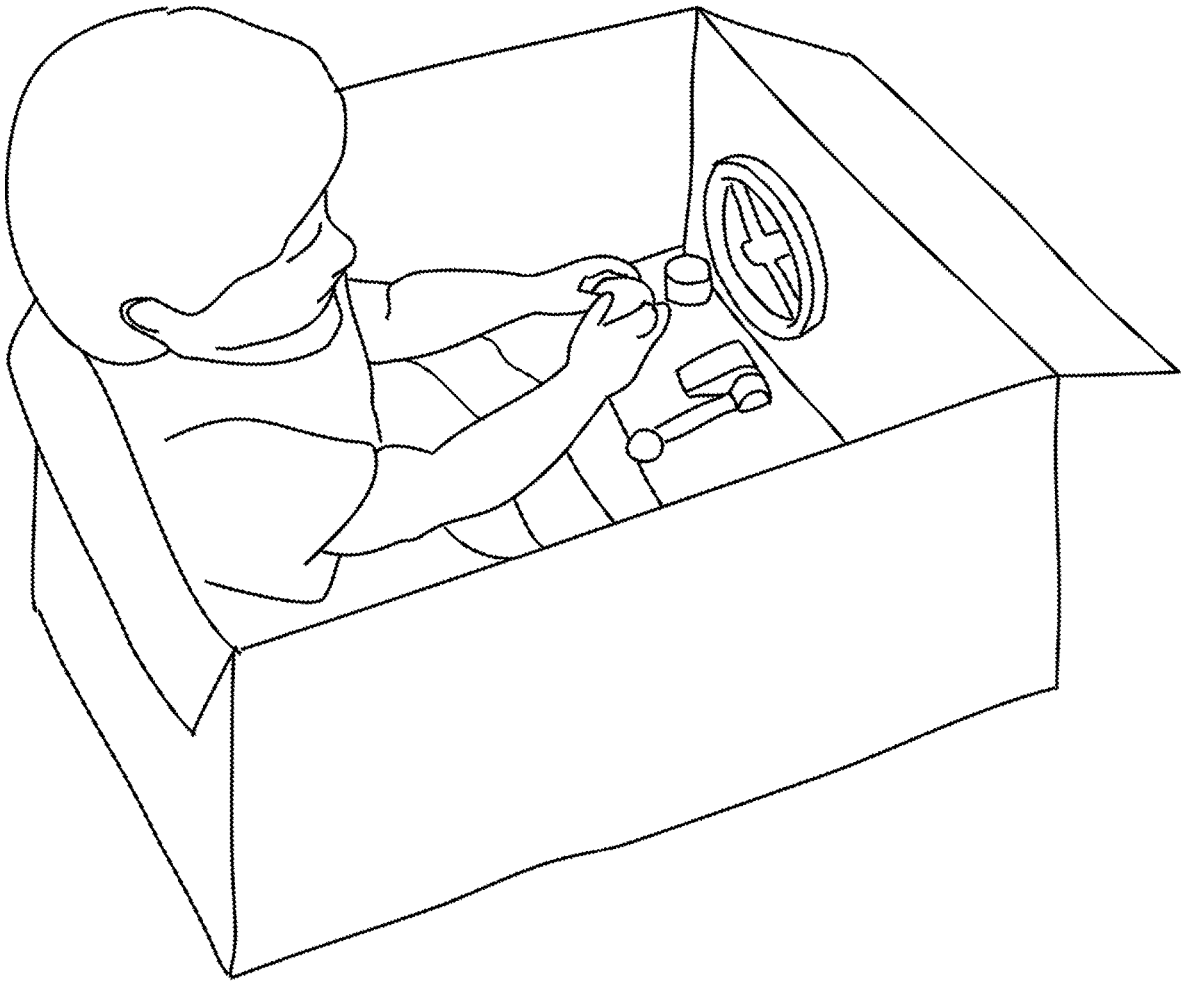
FIG. 18 shows a child playing with a dial, steering wheel and lever attached to a large cardboard box, in accordance with an embodiment of the present invention.

FIG. 18 shows a child playing with a dial, steering wheel and lever attached to a large cardboard box, in accordance with an embodiment of the present invention.

Figure 19:
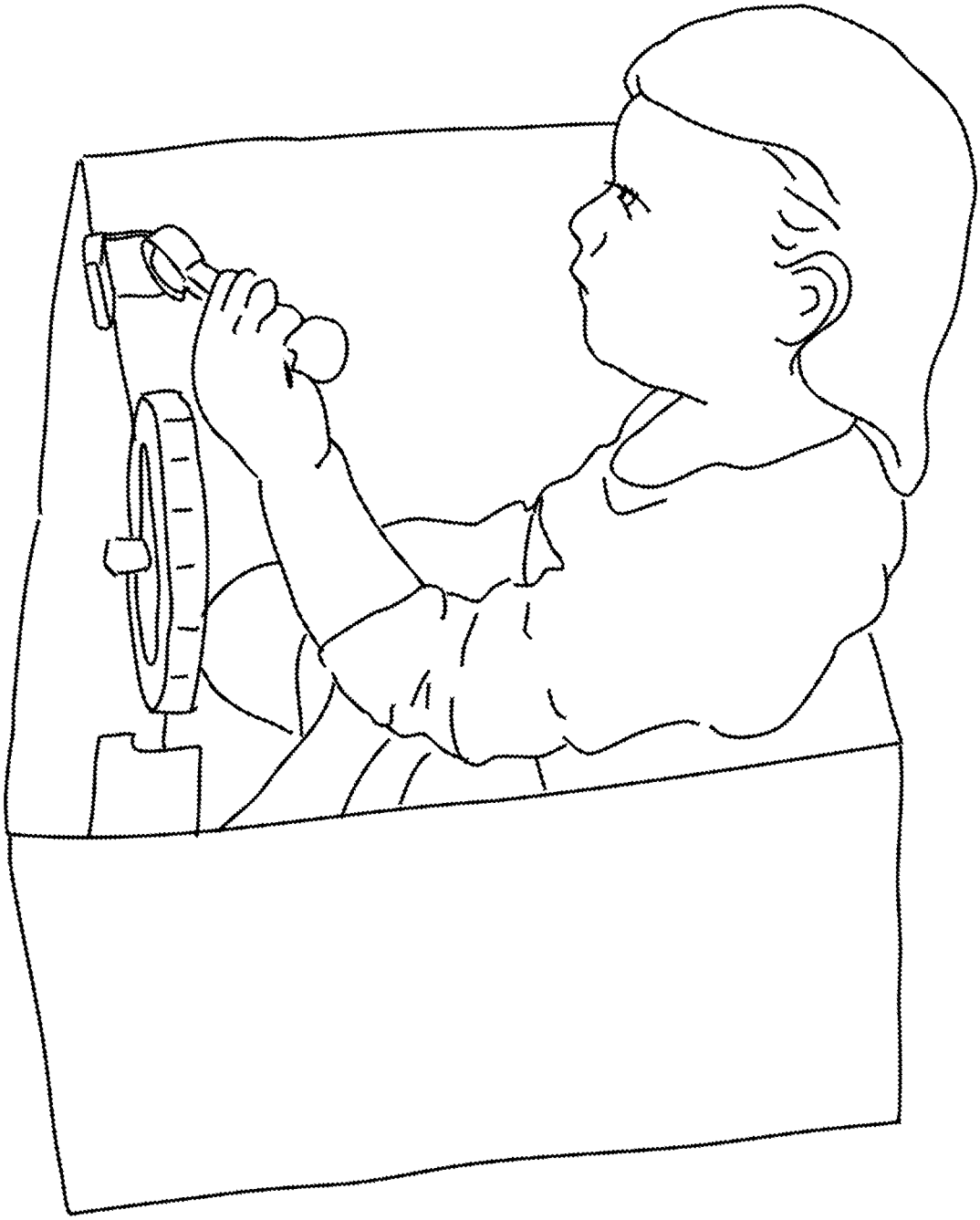
FIG. 19 shows a child attaching a socketed lever onto a plug securely clamped to a box, in accordance with an embodiment of the present invention.

FIG. 19 shows a child attaching a socketed lever onto a plug securely clamped to a box, in accordance with an embodiment of the present invention.

Figure 20A:
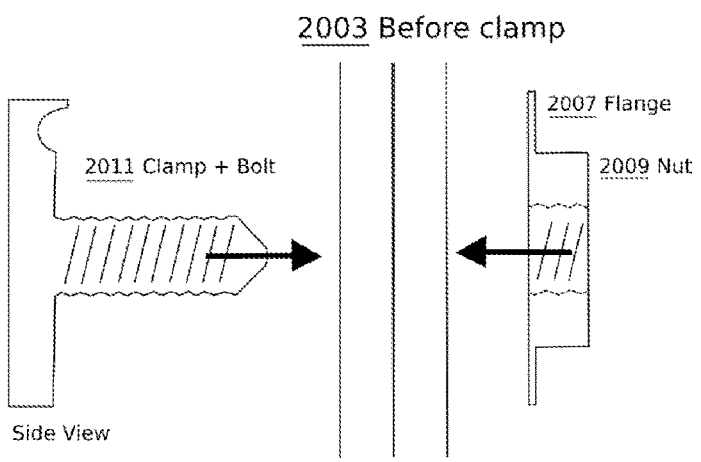
FIG. 20A shows an industrial version of the plastic torqueing clamp and nut without any safety features like the rounded cover on the nut or the safety tip on the clamp, in accordance with an embodiment of the present invention.

FIG. 20A shows an industrial version 2001 of the plastic torqueing clamp 2011 and nut 2009 without any safety features like the rounded dome on the nut or the safety tip on the clamp, in accordance with an embodiment of the present invention. The nut still retains the faces and flange 2007.

Figure 20B:
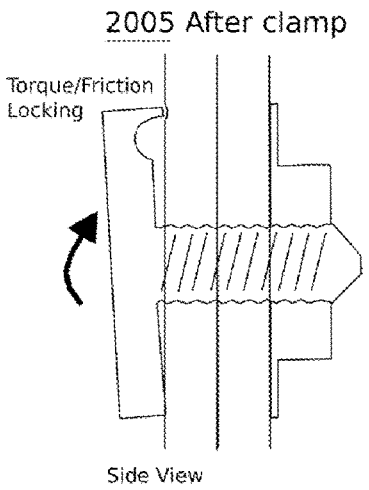
FIG. 20B shows an industrial version of the plastic torqueing clamp and nut without any safety features screwed together with moderate pressure applied and torque locking comparable to FIG. 2B, in accordance with an embodiment of the present invention.

FIG. 20B shows an industrial version of the plastic torqueing clamp 2011 and nut 2009 without any safety features screwed together with moderate pressure applied 2005 and torque locking comparable to FIG. 2B, in accordance with an embodiment of the present invention.

Figure 20C:
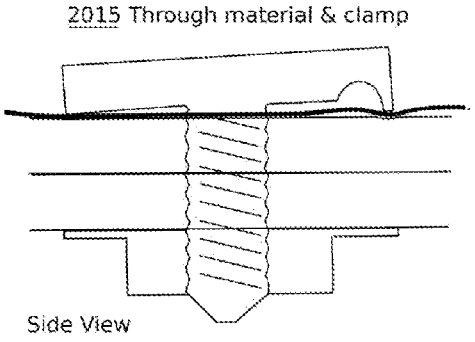
FIG. 20C shows an industrial version of the plastic torqueing clamp and nut without any safety features clamping through material comparable to FIG. 3A, in accordance with an embodiment of the present invention.

FIG. 20C shows an industrial version of the plastic torqueing clamp and nut without any safety features 2015 clamping through material comparable to FIG. 3A, in accordance with an embodiment of the present invention.

Figure 20D:
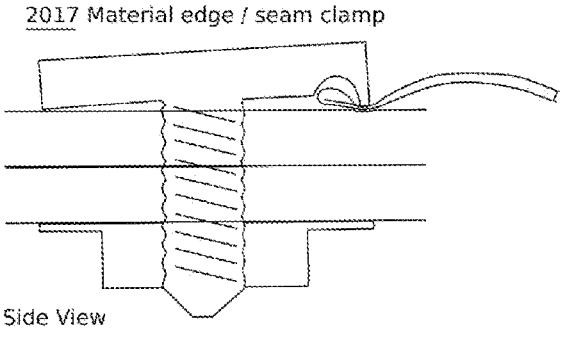
FIG. 20D shows an industrial version of the plastic torqueing clamp and nut without any safety features clamping edged or seamed material non-destructively comparable to FIG. 3B, in accordance with an embodiment of the present invention.

FIG. 20D shows an industrial version of the plastic torqueing clamp and nut without any safety features 2017 clamping edged or seamed material non-destructively comparable to FIG. 3B, in accordance with an embodiment of the present invention.

Figures 21A, 21B:
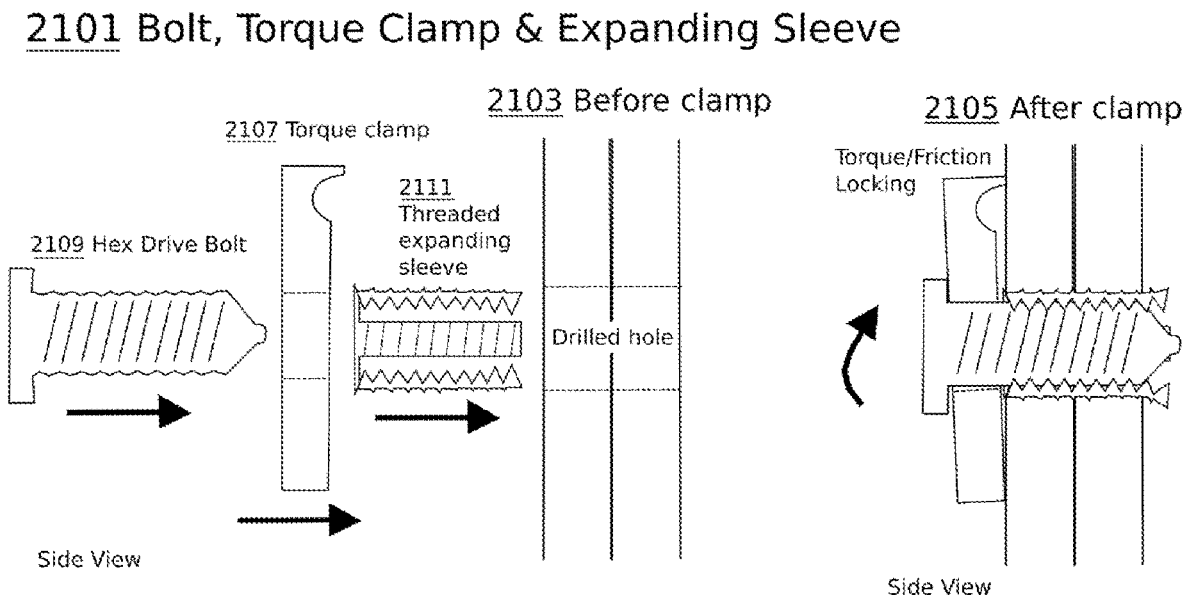
FIG. 21A shows a version of the torque clamp with a separate bolt, in accordance with an embodiment of the present invention. The bolt passes through a hole in the torque clamp. Then the bolt is held in place with an expanding internally threaded sleeve which replaces the need for a nut on the other side of the sheet material.
FIG. 21B shows the expanding internally threaded sleeve of FIG. 21A being forced outward locking the threaded sleeve under compression and friction into the drilled hole and past the end of the hole in the sheet material allowing the bolt to apply pressure to the torque clamp and in turn the material without need for a nut, in accordance with an embodiment of the present invention.

FIG. 21A shows a version of the torque clamp before use 2103 with a separate bolt 2109, in accordance with an embodiment of the present invention. The bolt passes through a hole in the torque clamp 2107. Then the bolt is held in place with an expanding internally threaded sleeve 2111 which replaces the need for a nut on the other side of the sheet material. The internally threaded sleeve 2111 is smaller diameter than the bolt 2109 and has slits running transversely to the axis of threading. These slits allow the threaded sleeve to expand as the bolt is tightened, forcing the outside of the threaded sleeve into the outside walls of the drilled hole. The elastic material of the sleeve 2111 is then held under high pressure against the hole wall by friction and expanding outside the back of the hole further preventing the bolt from being pulled out and allowing the hook on the torque clamp 2107 to apply torque pressure without requiring a nut.

FIG. 21B shows the expanding internally threaded sleeve of FIG. 21A being forced outward into the wall of the hole, and beyond the end of the hole locking the bolt into the drilled hole in the sheet material 2105 and applying pressure with the torqueing clamp 2107.

Figures 22A, 22B:
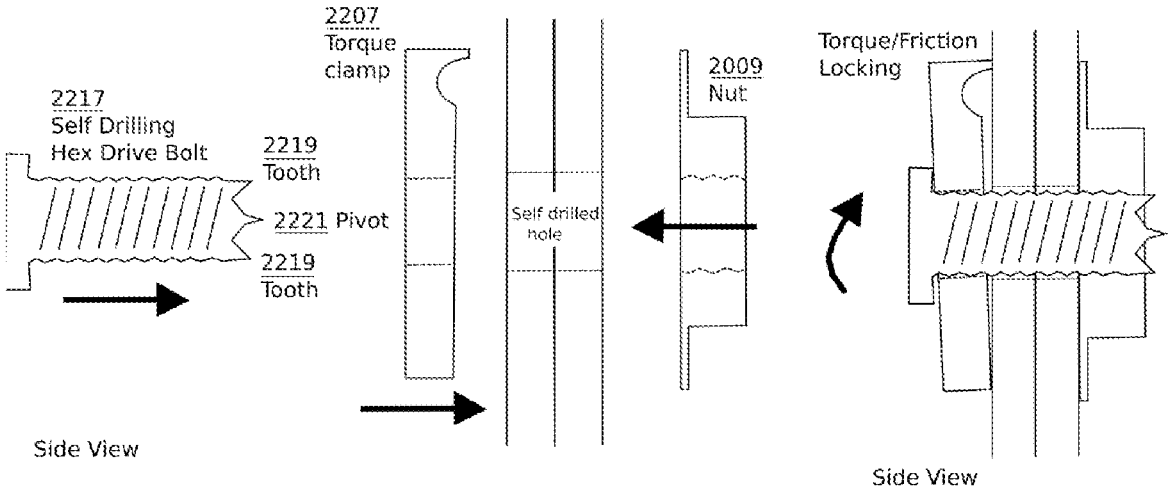
FIG. 22A shows a version of the torque clamp with a separate bolt, in accordance with an embodiment of the present invention. This bolt has optional single use self-drilling teeth added.
FIG. 22B shows a version of the torque clamp with a separate bolt, in accordance with an embodiment of the present invention. Once the bolt is in place a nut can be affixed on the other side of the material.

FIG. 22A shows a version of the torque clamp with a separate bolt 2217, in accordance with an embodiment of the present invention. This bolt has optional single use self-drilling teeth added 2219 and a pivot which contacts the material first 2221. This passes through the torque clamp 2207 and will drill through the material and thread into a nut 2009 on the other side.

FIG. 22B shows a version of the torque clamp with a separate bolt 2217, in accordance with an embodiment of the present invention. Once the bolt is in place through the material the nut 2009 can be threaded on the other side of the material and generate torque locking.

Figure 23A:
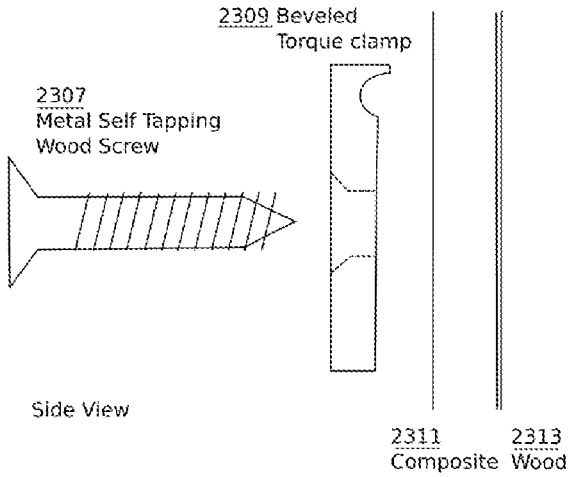
FIG. 23A shows a beveled torque clamp, in accordance with an embodiment of the present invention, with just a beveled hole to accommodate a normal metal screw for wood.

FIG. 23A shows a beveled torque clamp 2309, in accordance with an embodiment of the present invention, with just a beveled hole to accommodate a normal metal screw for wood 2307. The screw will go through the composite board 2311 and the clamp will hold this against the wooden backing material 2313.

Figure 23B:
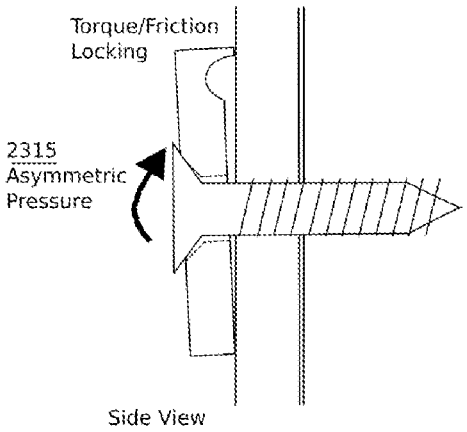
FIG. 23B shows a beveled torque clamp, in accordance with an embodiment of the present invention, with the screw applying asymmetric pressure.

FIG. 23B shows a beveled torque clamp 2309, in accordance with an embodiment of the present invention, with the screw 2307 applying asymmetric pressure. The composite sheet 2311 is held tightly against the wooden backing material 2313 as the screw bites into the wood.

Figure 24A:
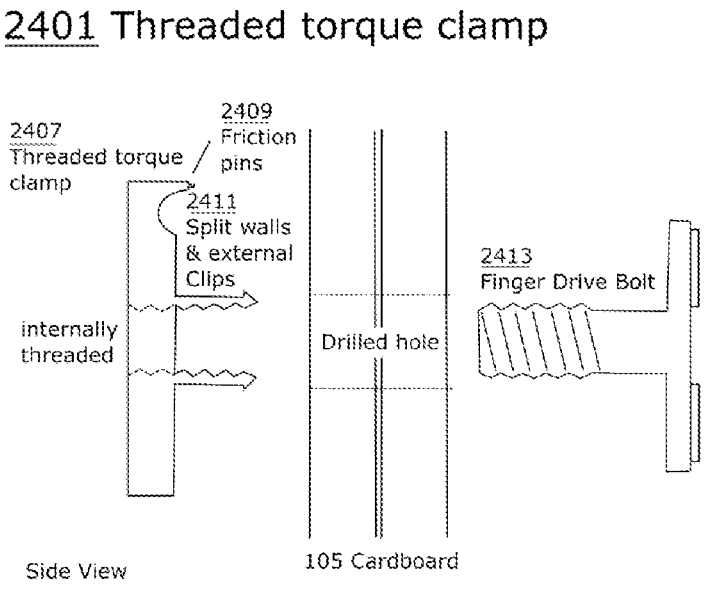
FIG. 24A shows a specialized threaded torque clamp and finger drive bolt, in accordance with an embodiment of the present invention, as a reusable fastener for sealing cardboard boxes and replacing packing tape. The threaded torque clamp has pins in the clamp hook to prevent rotation and split clips to hold itself on the underside of the cardboard. From the outside the finger drive bolt can be threaded into the clamp and tightened by hand.

FIG. 24A shows a specialized threaded torque clamp 2407 and finger drive bolt 2413, in accordance with an embodiment of the present invention, as a reusable fastener for sealing cardboard boxes and replacing packing tape 2401. The threaded torque clamp has pins 2409 in the clamp hook to prevent rotation and split clips 2411 which will fit through a hole in the cardboard 105 to hold the clamp on the underside of the cardboard. From the outside the finger drive bolt can be threaded into the clamp and tightened by hand.

Figure 24B:
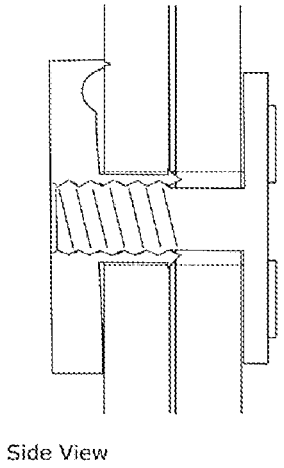
FIG. 24B shows a specialized threaded torque clamp and finger drive bolt, in accordance with an embodiment of the present invention, locked together clamping the cardboard box elements.

FIG. 24B shows a specialized threaded torque clamp 2407 and finger drive bolt 2413, in accordance with an embodiment of the present invention, locked together clamping the cardboard box elements.

Figure 24C:
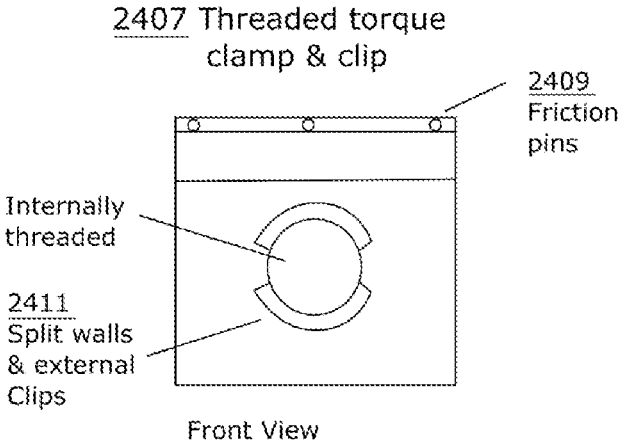
FIG. 24C shows a front on view of a friction clamp with friction pins to prevent rotation and split clips to hold the clamp into the hole drilled in the cardboard underside while the finger drive bolt is rotated from the outside, in accordance with an embodiment of the present invention.

FIG. 24C shows a front on view of a friction clamp 2407 with friction pins 2409 to prevent rotation and split clips 2411 to hold the clamp into the hole drilled in the cardboard underside while the finger drive bolt 2413 is rotated from the outside interlocking the thread, in accordance with an embodiment of the present invention.

Figure 24D:
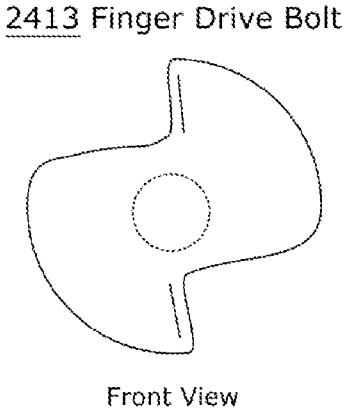
FIG. 24D shows the top of a finger drive bolt that is low profile and can be rotated with finger pressure not requiring a separate tool, in accordance with an embodiment of the present invention.

FIG. 24D shows the top of a finger drive bolt 2413 that is low profile and can be rotated with finger pressure not requiring a separate tool, in accordance with an embodiment of the present invention.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A mechanical system for locking together a set of sheets including sheets of semi-rigid material, the system comprising:

a clamp including:

a head having a clamp face and an outwardly disposed clamp back, the head having a periphery and the clamp face defining a face plane, and a threaded shaft, affixed to the clamp face, having (i) a longitudinal axis disposed normally to the face plane before the clamp has been placed in use, (ii) a first end affixed to the clamp face, and (iii) a pointed second end configured to penetrate through the set of sheets until the clamp head abuts an exposed first side of the set of sheets, and the second end emerges from an exposed second side of the set of sheets; and a nut, having an internal thread, configured to support its being screwed onto the threaded shaft, the nut having a contact face forced into contact with the exposed second side when the nut is tightened;

wherein:

(a) the clamp face is asymmetrically configured to include a gripping region in a first circumferential position of the clamp face and a leverage region in a second circumferential position opposed to the first circumferential position, the gripping region including a trough disposed near the periphery of the head and defining a hook, disposed between the trough and the periphery, the hook having a tip at the periphery that projects axially beyond the face plane in a direction normal to the face plane, so that the gripping region is structured, along a radially outward path from the shaft, to include, first, a planar portion corresponding to the clamp face, next, the trough, and thereafter, the tip of the hook;

(b) the leverage region is configured to project axially, in a region near the periphery of the head, so that, as the nut is tightened, the axially projecting portion of the leverage region first contacts the first side of the set of sheets, and upon continued tightening of the nut exerts a torque on the head, relative to the threaded shaft, elastically deforming the clamp head relative to the shaft to change the angle of the face plane of the clamp face relative to the longitudinal axis so as to cause the hook of the gripping region to dig into the first side and to prevent rotation of the head relative to the set of sheets.

2. A mechanical system according to claim 1, wherein the second end of the threaded shaft has a safety tip that facilitates penetration of the second end through the semi-rigid material.

3. A mechanical system according to claim 1, wherein the nut is configured with a flange to provide an enlarged surface area of the contact face.

4. A mechanical system according to claim 1, wherein the nut is configured with a safety dome that restricts a length by which the second end can extend into the internal thread of the nut.

5. A mechanical system according to claim 1, wherein the nut has an exposed side, opposed to the contact face, configured to engage with a suitable wrench.

6. A mechanical system according to claim 1, wherein the first side is of a sheet of thin yielding material and, the nut upon continued tightening exerts a torque on the head, relative to the threaded shaft, elastically deforming the clamp so as to cause the hook of the gripping region to dig into the first side to an extent sufficient to engage the hook against sheets of semi-rigid material in the set.

7. A plug and socket system for use with the mechanical system of claim 1, the plug configured for use with the clamp as an integral part thereof, the plug configured for removable attachment of the socket.

8. A plug and socket system according to claim 7, wherein the plug and clamp are formed as a single piece.

9. A plug and socket system according to claim 7, wherein the plug includes a plug barrel having a solid core and a plurality of circumferentially disposed flexible members, each member having a lip disposed radially outward, and wherein each of the members is configured to flex for insertion into the socket and the solid core provides a high strength inflexible rotational joint.

10. A mechanical system according to claim 1, wherein the clamp face has an effective radius and the shaft has an effective radius where it is affixed to the clamp face, and the effective radius of the clamp face is more than twice the effective radius of the shaft.

* * * * *